US007335070B2

(12) United States Patent
Yoda et al.

(10) Patent No.: US 7,335,070 B2
(45) Date of Patent: Feb. 26, 2008

(54) SHIFT OPERATION APPARATUS FOR OUTBOARD MOTOR, ELECTRONIC REMOTE CONTROL APPARATUS FOR MEDIUM-SIZED BOAT, AND ENGINE CONTROL APPARATUS

(75) Inventors: Masumi Yoda, Yokohama (JP); Yoshikazu Hoshina, Yokohama (JP); Azuma Sasabuchi, Yokohama (JP)

(73) Assignee: NHK Teleflex Morse Co., Ltd., Yokohama (JP)

( * ) Notice: Subject to any disclaimer, the term of this patent is extended or adjusted under 35 U.S.C. 154(b) by 328 days.

(21) Appl. No.: 11/069,851

(22) Filed: Mar. 1, 2005

(65) Prior Publication Data

US 2005/0170715 A1 Aug. 4, 2005

Related U.S. Application Data

(63) Continuation-in-part of application No. 10/891,848, filed on Jul. 15, 2004, now abandoned.

(30) Foreign Application Priority Data

| | | |
|---|---|---|
| Jul. 17, 2003 | (JP) | 2003-198435 |
| Nov. 19, 2003 | (JP) | 2003-389768 |
| Feb. 20, 2004 | (JP) | 2004-045066 |
| Feb. 20, 2004 | (JP) | 2004-045067 |

(51) Int. Cl.
*B63H 21/22* (2006.01)
*B63H 21/21* (2006.01)

(52) U.S. Cl. ..... 440/1; 440/84

(58) Field of Classification Search ..... 440/1
See application file for complete search history.

(56) References Cited

U.S. PATENT DOCUMENTS

| | | | | |
|---|---|---|---|---|
| 3,858,101 | A * | 12/1974 | Schmiedel et al. | 318/448 |
| 5,492,493 | A * | 2/1996 | Ohkita | 440/86 |
| 2003/0064642 | A1 * | 4/2003 | Funayose et al. | 440/84 |

FOREIGN PATENT DOCUMENTS

| | | |
|---|---|---|
| JP | 4-94431 | 3/1992 |

* cited by examiner

*Primary Examiner*—Jesús D Sotelo
(74) *Attorney, Agent, or Firm*—Frishauf, Holtz, Goodman & Chick, P.C.

(57) ABSTRACT

A shift operation apparatus for an outboard motor of the present invention comprises a case fixed to an outboard motor, a motor provide at the case, a worm gear which is rotated by the motor, a worm wheel engages with the worm gear, an output shaft provided so as to freely rotate, a gear mechanism which transmits rotation of the worm wheel to the output shaft, an output arm which is attached to the output shaft, and which moves a range from a shift forward position to a shift reverse position with a neutral position being a boundary, a sensor which outputs a signal relating to a shift position of the output arm to a control circuit, and a force transmitting member whose one end is connected to the output arm, and whose other end is connected to a portion to be operated of a shift mechanism.

9 Claims, 19 Drawing Sheets

SHIFT OPERATION APPARATUS FOR OUTBOARD MOTOR, ELECTRONIC REMOTE CONTROL APPARATUS FOR MEDIUM-SIZED BOAT, AND ENGINE CONTROL APPARATUS

CROSS-REFERENCE TO RELATED APPLICATIONS

This is a Continuation-in-Part application of U.S. patent application Ser. No. 10/891,848, filed Jul. 15, 2004, now abandoned the entire contents of which are incorporated herein by reference.

This application is based upon and claims the benefit of priority from prior Japanese Patent Applications No. 2003-198435, filed Jul. 17, 2003; No. 2003-389768, filed Nov. 19, 2003; No. 2004-045066, filed Feb. 20, 2004; and No. 2004-045067, filed Feb. 20, 2004, the entire contents of all of which are incorporated herein by reference.

BACKGROUND OF THE INVENTION

1. Field of the Invention

The present invention relates to a shift operation apparatus for an outboard motor, an electronic remote control apparatus for a medium-sized ship, and an engine control apparatus which are for remote-controlling a shift mechanism (throttle) of an outboard motor (engine) of a medium-sized ship or the like, and in particular, to apparatuses which can be made small, and in which the operational ease thereof is improved and occurrence of trouble can be prevented.

The present invention relates to an electronic remote control apparatus for a medium-sized ship by which a helmsman remote-controls an engine such as an outboard motor of a medium-sized ship or the like from a pilothouse, and in particular, to an electronic remote control apparatus for a medium-sized ship by which information based on a trouble of an engine can be precisely notified to a helmsman.

The present invention relates to an engine control apparatus for remote-controlling shift control and throttle control of an engine of a medium-sized ship from a pilothouse, and in particular, to an engine control apparatus by which it is possible to prevent a motor or a shift arm and a throttle arm of an outboard motor from being broken due to the failure of an electriced system.

2. Description of the Related Art

An engine control apparatus for remote-controlling shift operation or the like of an engine of a medium-sized ship has been known. The conventional engine control apparatus has a remote control box installed in a pilothouse or the like, a driving unit in which a motor and a gear mechanism actuated on the basis of an signal output by the remote control box, or the like are built-in, a push pull cable for transmitting a driving force generated by the motor to a portion to be operated of a shift mechanism at the engine side, or the like. The driving unit is accommodated in the interior of a hull.

In the conventional engine control apparatus, it is necessary to connect the driving unit provided at the hull side and the portion to be operated in the shift mechanism of the outboard motor via the push pull cable for shift operation. Therefore, there is a great limit to the layout of the push pull cable, and there is a problem on the general versatility.

Further, a sensor for detecting positions (shift neutral, shift forward, and shift reverse) of the shift mechanism is built in the driving unit which is located at a position considerably away from the engine. Moreover, there is the long push pull cable between the driving unit at the hull side and the shift mechanism at the outboard motor side. Therefore, there is the concern that some gap arises between an actual position of the shift mechanism and a shift positional signal detected by the sensor. Accordingly, it has been required that the shift position is accurately detected by the sensor in the vicinity of the engine.

On the other hand, as a method of controlling an engine in a medium-sized ship, an electronic remote control apparatus for a medium-sized ship which is installed in a pilothouse, and by which a motor connected to an engine is controlled by converting operation of a control head by a helmsman into electric information, has been known. In this electronic remote control apparatus for a medium-sized ship, a technique in which, when some unusualness arises in the engine, those are sensed by a sensor which installed therein in advance and are alarmed to the helmsman by flickering of a lamp, buzzer sounds, 7 segment LED, or the like has been conventionally used.

There has been the following problem in the electronic remote control apparatus for a medium-sized ship described above. Namely, with respect to this type of alarm, because an unusual portion is indicated by the number of flickering of a lamp, the way of buzzer sounding, the 7 segment LED, or the like, the helmsman must refer to a manual, and it is difficult to recognize the unusual portion.

An engine control apparatus for remote-controlling shift control and throttle control of an outboard motor of a medium-sized ship has been known. Such an engine control apparatus has a remote control box installed in a pilothouse or the like, and a driving unit in which a motor and a gear mechanism actuated on the basis of an operation signal output by the remote control box are built-in, and a driving force generated by the motor is transmitted to the shift mechanism (shift arm) and the portion to be operated of the throttle mechanism (throttle arm) of the outboard motor, and those are made to be actuated.

A battery voltage is directly applied to the motor, and the motor is controlled by only ON/OFF in accordance with an operation signal.

There has been the following problem in the engine control apparatus described above. Namely, when a minus line of the power sources line of the battery is taken off due to the vibration of a medium-sized ship, a high voltage is applied to a control unit from an alternator, and the voltage is directly applied to the motor of the driving unit. Therefore, there has been the concern that the motor or the shift mechanism and the throttle mechanism of the outboard motor are broken due to excessive electric current being made to flow to the motor.

On the other hand, as a battery voltage used for a medium-sized ship, generally, 12V and 24V are mixed, and a motor for 12V and a motor for 24V which are respectively suitable for the respective battery voltages are used. Therefore, when the driving unit is selected, there is the complication that a motor which is a type suitable for a battery voltage must be selected.

BRIEF SUMMARY OF THE INVENTION

An object of the present invention is to provide a shift operation apparatus for an outboard motor by which a shift position of an operating lever and a shift position of a shift mechanism are made to more precisely match to one another by precisely detecting the shift position by a sensor in the vicinity of an outboard motor, and the apparatus can be made small.

The shift operation apparatus for an outboard motor of the present invention comprises: a case fixed to an outboard motor; a motor provide at the case; a worm gear which is accommodated in the case and which is rotated by the motor; a worm wheel which is accommodated in the case and which engages with the worm gear; an output shaft provided so as to freely rotate at the case; a gear mechanism which transmits rotation of the worm wheel to the output shaft; an output arm which is attached to the output shaft outside the case, and which moves a range from a shift forward position to a shift reverse position with a neutral position being a boundary; a sensor which is accommodated in the case and which outputs a signal relating to a shift position of the output arm to a control circuit; and a force transmitting member whose one end is connected to the output arm, and whose other end is connected to a portion to be operated of a shift mechanism.

According to the present invention, the shift operation apparatus actuated by an electric signal is disposed in the vicinity of an engine inside the outboard motor, and because the shift mechanism of the engine is operated by the shift operation apparatus, there is no need to cable a push pull cable between a hull and the outboard motor. Moreover, the sensor for detecting a shift position is built into the shift operation apparatus disposed in the vicinity of the engine, an actual shift position of the shift mechanism can be precisely detected. Accordingly, the shift position of the operating lever and the shift position of the shift mechanism can be made to precisely match to one another, and the apparatus can be made small.

Further, an object of the present invention is to provide an electronic remote control apparatus for a medium-sized ship by which the unusualness can be notified to a helmsman immediately after the time when some unusualness occurs in the engine or the like.

The electronic remote control apparatus for a medium-sized ship of the present invention comprises: a control head which is arranged in a pilothouse, and which outputs an operation signal on the basis of an operating instruction to the engine input by the helmsman; and a control unit which is connected to or built into the control head, and which outputs a driving signal of the engine on the basis of the operation signal, wherein the control unit has a detecting unit which determines it is unusual when the operation signal is not normally received, and outputs an alarm signal, and the control head has a display unit which specifies and displays an unusual portion on the basis of the alarm signal.

According to the present invention, the unusualness can be notified to the helmsman immediately after the time when some unusualness occurs in the engine or the like.

Moreover, an object of the present invention is to provide an engine control apparatus by which a high voltage is prevented from being applied to the motor even when a high voltage is applied to the control unit due to a minus line of the power source lines being taken off, and by which the motor, or a shift arm and a throttle arm of the outboard motor can be prevented from being broken.

The engine control apparatus of the present invention comprises: a control unit which outputs an operation signal corresponding to an operating instruction operated by a helmsman; an actuator which actuates a shift mechanism and a throttle mechanism of an engine of an outboard motor by a driving force of an electric motor; and a control unit which supplies electric power from an power source to the electric motor on the basis of the operation signal from the control unit, wherein the control unit has a first upstream transistor and a first downstream transistor whose main current-carrying paths are connected in series, and a second upstream transistor and a second downstream transistor whose main current-carrying paths are connected in series, and the motor is connected between a series connecting point of the first upstream transistor and the first downstream transistor and a series connecting point of the second upstream transistor and the second downstream transistor, and a current path from one direction to another direction with respect to the motor is formed by turning the first upstream transistor and the second downstream transistor as a pair on, and a quantity of electric current made to flow in the current path is adjusted by PWM-driving the second downstream transistor, and on the other hand, a current path from one direction to another direction with respect to the motor is formed by turning the second upstream transistor and the first downstream transistor as a pair on, and a quantity of electric current made to flow in the current path is adjusted by PWM-driving the first downstream transistor.

According to the present invention, a high voltage is prevented from being applied to the motor even when a high voltage is applied to the control unit due to the minus line of the power source lines being taken off, and the motor, or the shift arm and the throttle arm of the outboard motor can be prevented from being broken down.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

FIG. 4 is a plan view of a part of an outboard motor in which the shift operation apparatus for an outboard motor shown in FIG. 3 is built-in.

FIG. 5 is a side view schematically showing a remote control box, an outboard motor for a medium-sized ship, and the like.

FIG. 14 is a side view of a part of an outboard motor in which the shift operation apparatus for an outboard motor is built-in.

DETAILED DESCRIPTION OF THE INVENTION

Figure 1:
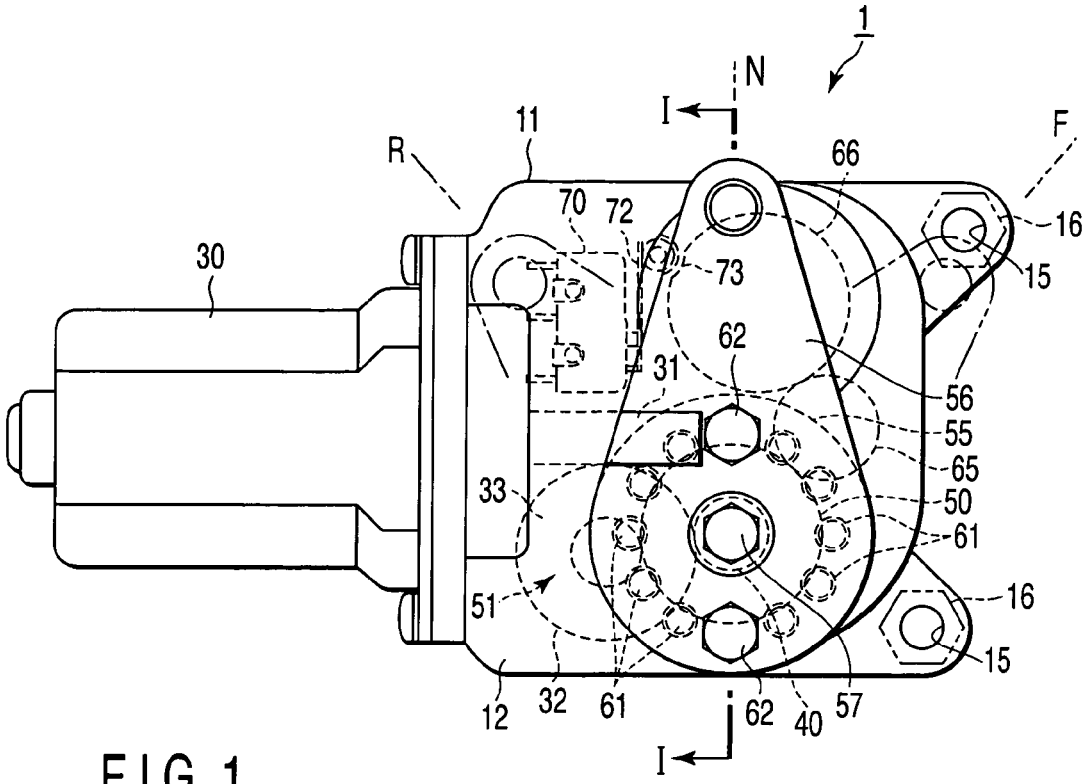
FIG. 1 is a front view of a shift operation apparatus for an outboard motor showing a first embodiment of the present invention.
Figure 2:
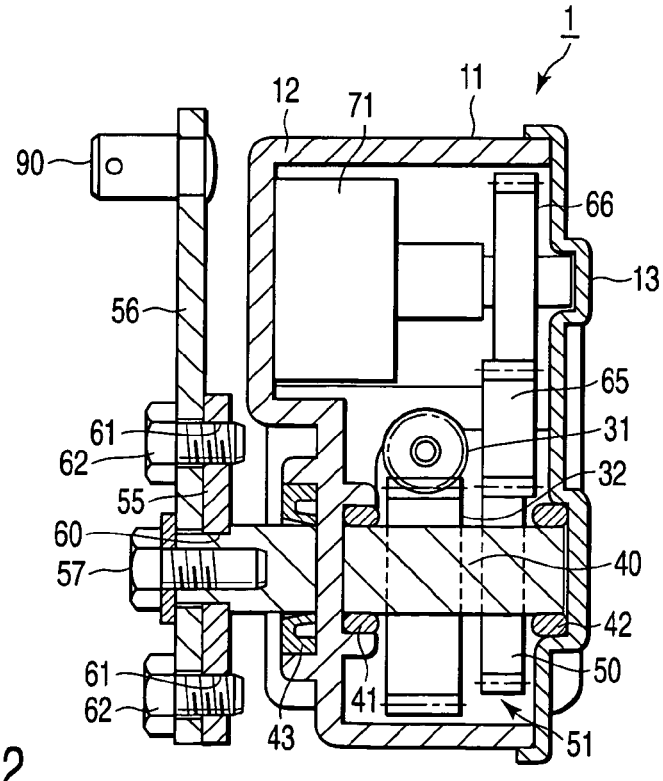
FIG. 2 is a sectional view of the shift operation apparatus for an outboard motor taken along line I-I in FIG. 1.
Figure 3:
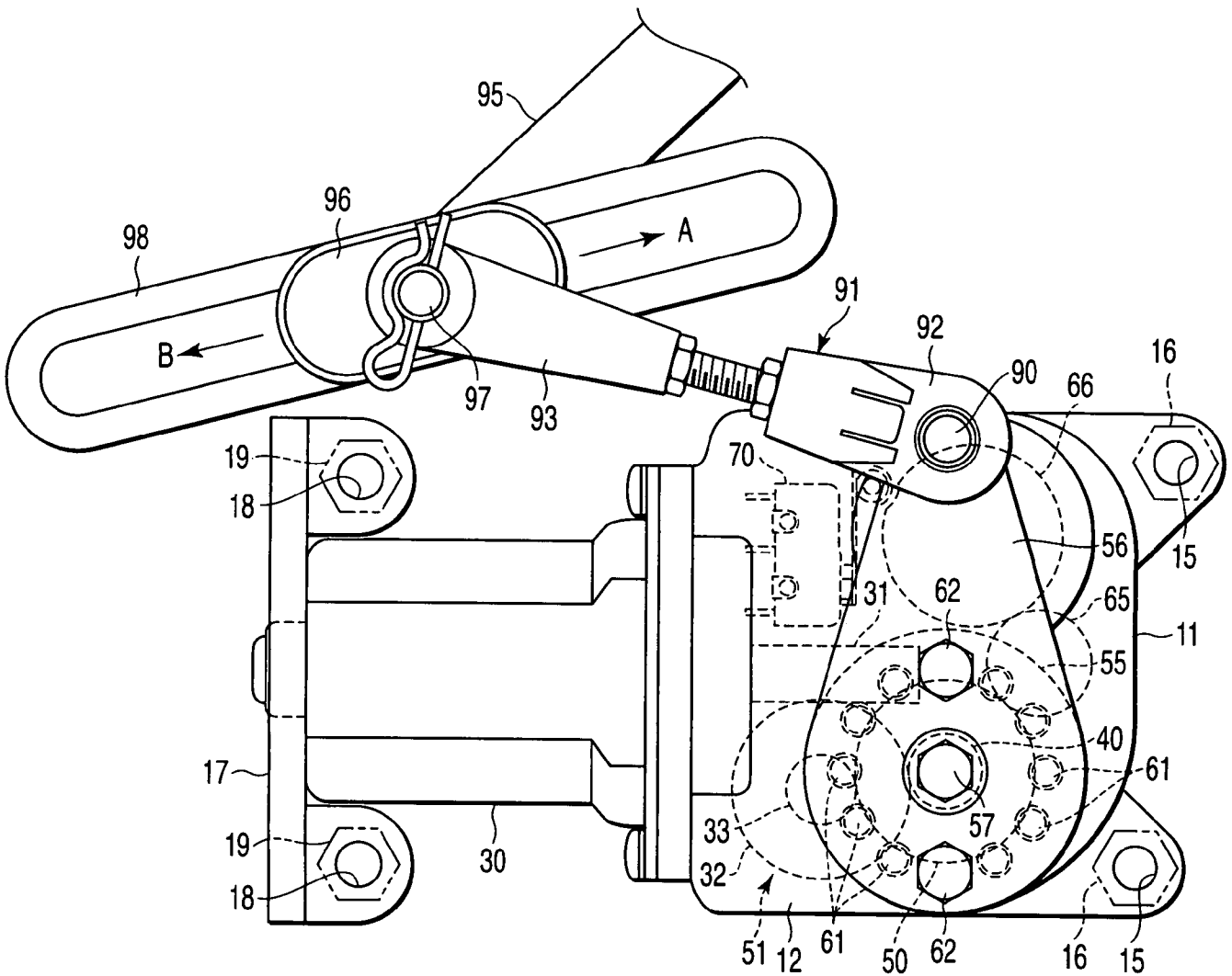
FIG. 3 is a front view when a link rod is attached to the shift operation apparatus for an outboard motor shown in FIG. 1.
Figure 4:
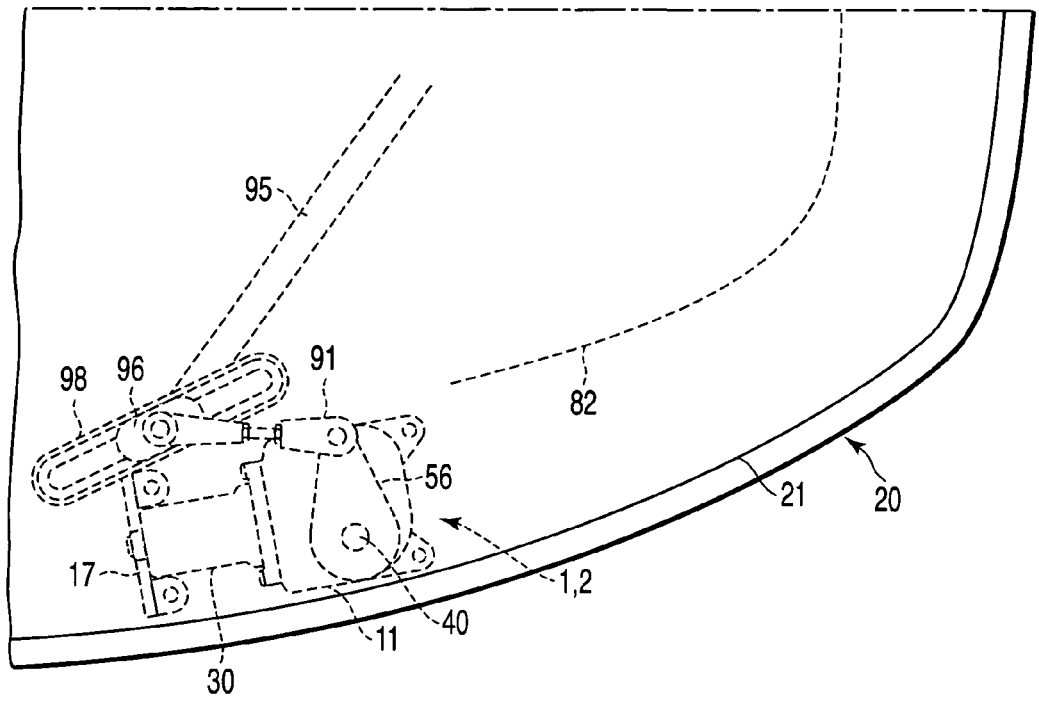
Figure 5:
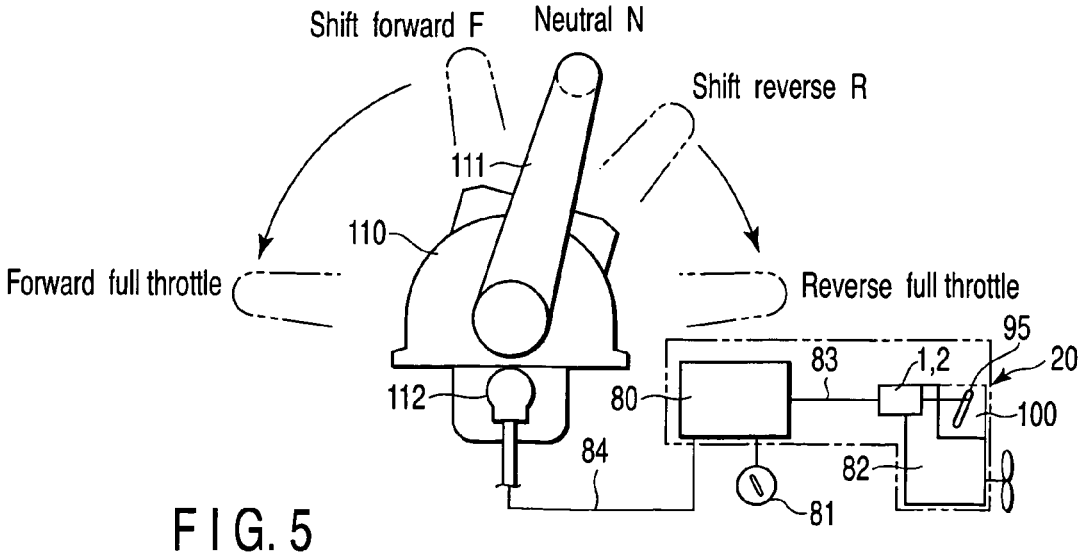

FIG. 1 is a front view of a shift operation apparatus 1 for an outboard motor according to a first embodiment of the present invention, FIG. 2 is a sectional view of the shift operation apparatus for an outboard motor taken along line I-I in FIG. 1, FIG. 3 is a front view when a link rod is attached to the shift operation apparatus for an outboard motor shown in FIG. 1, FIG. 4 is a plan view of a part of an outboard motor in which the shift operation apparatus for an outboard motor shown in FIG. 3 is built-in, and FIG. 5 is a side view schematically showing a remote control box for a medium-sized ship, an outboard motor, and the like.

As shown in FIG. 1, the shift operation apparatus 1 for an outboard motor has a waterproof structured case 11. As shown in FIG. 2, the case 11 has a case body 12 and a cover member 13.

As shown in FIG. 1, mounting holes 15 are formed at the case body 12. The case 11 is arranged at the inner side of a top cover 21 of an outboard motor 20 (a part thereof is shown in FIG. 4) by bolts 16 inserted into the mounting holes 15 and bolts 19 inserted into mounting holes 18 of a mounting bracket 17 (shown in FIG. 3) attached to a motor 30 as needed.

The waterproof DC motor 30 is provided at the case 11. This motor 30 can be rotated in the first direction and the second direction opposite thereto by switching a direction of electric current. A worm gear 31 is attached to the output shaft of the motor 30. The worm gear 31 is accommodated inside the case 11.

A worm wheel 32 and a first spur gear 33 rotating so as to be integrated with the worm wheel 32 are accommodated inside the case 11. The worm wheel 32 engages with the worm gear 31.

An output shaft 40 is provided so as to freely rotate at the case 11. Bearings 41 and 42 are provided between the case 11 and the output shaft 40. A seal member 43 for waterproofing is provided in the vicinity of the bearing 41.

A second spur gear 50 is attached to the output shaft 40. The second spur gear 50 engages with the first spur gear 33. Because the number of the teeth of the second spur gear 50 is greater than that of the first spur gear 33, the rotation of the first spur gear 33 is transmitted so as to be reduced to the second spur gear 50. These spur gears 33 and 50 form a gear mechanism 51 for transmitting the rotation of the worm wheel 32 to the output shaft 40.

An adjustment plate 55 and an output arm 56 are attached to the output shaft 40. These adjustment plate 55 and output arm 56 are positioned outside the case 11, and prevention of slipping-out of the output shaft 40 is applied thereto by a bolt 57. The output arm 56 is made to be able to move reciprocally between a shift forward position F and a shift reverse position R with the a neutral position N being the boundary as one example is shown in FIG. 1.

A hole 60 formed at the center of the adjustment plate 55 is fitted into the output shaft 40 so as to be unable to rotate. A plurality of tap holes 61 are formed at the adjustment plate 55. These tap holes 61 are formed on the same circle centering around the output shaft 40 at a constant pitch, and the output arm 56 is fixed to the adjustment plate 55 due to the bolts 62 being screwed in a selected pair of selected tap holes 61.

When the bolts 62 are taken off from the tap holes 61, the output arm 56 can be rotated with respect to the adjustment plate 55. When an attempt is made to change the direction of the output arm 56 in accordance with a type of the outboard motor 20, or the like, the bolts 62 are taken off from the tap holes 61, the output arm 56 is made to direct to a desired direction, and thereafter, the output arm 56 is fixed to the adjustment plate 55 due to the bolts 62 being screwed into the tap holes 61.

In this way, the output arm 56 can be made to direct to the desired direction with respect to the case 11. An arm adjusting mechanism is configured of the adjustment plate 55 having the tap holes 61 and the bolts 62 screwed in the tap holes 61. Note that, as another example of an arm adjusting mechanism, a spline is formed at the output shaft 40, and moreover, a spline slot fitted into the spline may be formed at the output arm 56. In accordance with such a structure as well, a relative position in the direction of rotation of the output arm 56 with respect to the output shaft 40 can be adjusted.

In the interior of the case 11, a third spur gear 65 engages with the second spur gear 50. A fourth spur gear 66 engages with the third spur gear 65. The fourth spur gear 66 is rotated so as to be integrated with potentiometer 71 described below.

A microswitch 70 for permitting an engine to start and the potentiometer 71 (shown in FIG. 2) functioning as a shift position detecting sensor are accommodated in the interior of the case 11. The front end portion of a detecting lever 72 of the microswitch 70 touches the outer peripheral surface of the fourth spur gear 66.

When the output arm 56 is positioned at the neutral position N, the front end portion of the detecting lever 72 enters a concave portion 73 formed at the fourth spur gear 66, whereby the microswitch 70 is turned on. When the microswitch 70 is turned on, the signal thereof is output to a control circuit 80 (shown in FIG. 5), whereby starting of an engine 82 by a starter switch 81 is permitted. The control circuit 80 and the sift operation apparatus 1 are connected to one another via an electric cable 83. An electric cable 84 connected to the control circuit 80 is cabled between the hull (not shown) and the outboard motor 20.

The potentiometer 71 detects the rotating quantity of the spur gear 66 at the time when the output arm 56 moves from the neutral position N to the shift forward position F. Further, the potentiometer 71 detects the rotating quantity of the spur gear 66 at the time when the output arm 56 moves from the neutral position N to the shift reverse position R. These detection signals are output to the control circuit 80.

When it is detected by the potentiometer 71 that the output arm 56 has moved up to the shift forward position F, the motor 30 is stopped by the control circuit 80. When it is detected by the potentiometer 71 that the output arm 56 has moved up to the shift reverse position R as well, the motor 30 is stopped.

As shown in FIG. 3, one end 92 of a link rod 91 is connected to a pin 90 provided at the output arm 56. The other end 93 of the link rod 91 is connected to an end portion 96 of a shift lever 95 serving as a portion to be operated, by means of a pin 97. The end portion 96 of the shift lever 95 can move along a shift rail 98 in the directions shown by arrows A and B in FIG. 3, and when the end portion 96 of the shift lever 95 moves in arrow A, the shift mechanism 100 (schematically shown in FIG. 4) is switched to the forward position, and when the end portion 96 of the shift lever 95 moves in arrow B, the shift mechanism 100 is switched to the reverse position.

An operating lever 111 of a remote control box 110 (shown in FIG. 5) provided at a pilothouse or the like can be made to move up to the full throttle position at the forward side via the shift forward position F from the neutral position N. Further, the operating lever 111 can be made to move up to the full throttle position at the reverse side via the shift reverse position R from the neutral position N.

The position of the operating lever 111 is detected by a potentiometer 112. When the operating lever 111 moves up to the shift forward position F, the motor 30 of the shift operation apparatus 1 is rotated in the first direction by a signal output by the control circuit 80. In accordance therewith, the output arm 56 moves up to the forward position F. When the operating lever 111 moves up to the shift reverse position R, the motor 30 rotates in the second direction, and the output arm 56 moves up to the reverse position R.

Next, the effect of the shift operation apparatus 1 having the above-described configuration will be described.

When the operating lever 111 of the remote control box 110 is positioned at the neutral position N, the motor 30 of the shift operation apparatus 1 is being stopped. At that time, the output arm 56 is positioned at the neutral position N.

When the operating lever 111 of the remote control box 110 is made to move up to the shift forward position F, the motor 30 of the shift operation apparatus 1 rotates in the first direction on the basis of a signal output by the potentiometer 112, and the output arm 56 moves up to the shift forward position F via the first spur gear 33 and the second spur gear 50.

In accordance therewith, the end portion 96 of the shift lever 95 moves in the direction of arrow A in FIG. 3 via the link rod 91, and the shift mechanism 100 enters the forward position. When the output arm 56 has completed moving up to the forward position F, because the motor 30 stops on the basis of a signal output by the potentiometer 71, the shift mechanism 100 is maintained at the forward position.

The operating lever 111 of the remote control box 110 is made to further move forward from the shift forward position F, a throttle mechanism (not shown) of the engine 82 is actuated to the accelerating side on the basis of a signal output by the control circuit 80 from the potentiometer 112.

When the operating lever 111 of the remote control box 110 is made to move up to the shift reverse position R, the motor 30 rotates in the second direction on the basis of a signal output by the potentiometer 112, and the output arm 56 moves up to the shift reverse position R via the first spur gear 33 and the second spur gear 50.

In accordance therewith, the end portion 96 of the shift lever 95 moves in the direction of arrow B in FIG. 3 via the link rod 91, and the shift mechanism 100 goes into the reverse position. When the output arm 56 has completed moving up to the reverse position R, because the motor 30 stops on the basis of a signal output by the potentiometer 71, the shift mechanism 100 is maintained at the reverse position.

When the operating lever 111 of the remote control box 110 is made to further move into reverse from the shift reverse position R, a throttle mechanism (not shown) of the engine 82 is actuated to the accelerating side on the basis of a signal output by the control circuit 80 from the potentiometer 112.

Note that, provided that a quick release type pole joint which can be attached and detached is used as the connecting portion of the output arm 56 and the link rod 91, it is possible to carry out shift operation by detaching the pole joint at the time of the failure of the motor 30, or the like, and manually operating the link rod 91.

In the embodiment described above, the microswitch 70 and the potentiometer 71 are used as sensors for detecting the position of the output arm 56.

Figure 6:
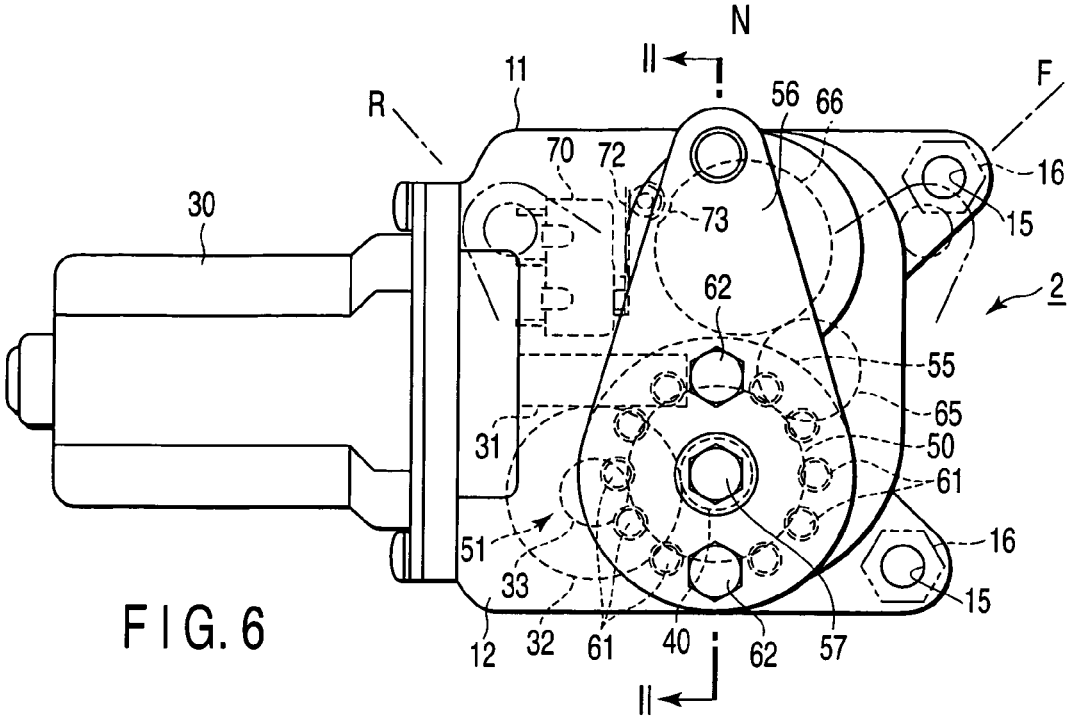
FIG. 6 is a front view of a shift operation apparatus for an outboard motor showing a second embodiment of the present invention.
Figure 7:
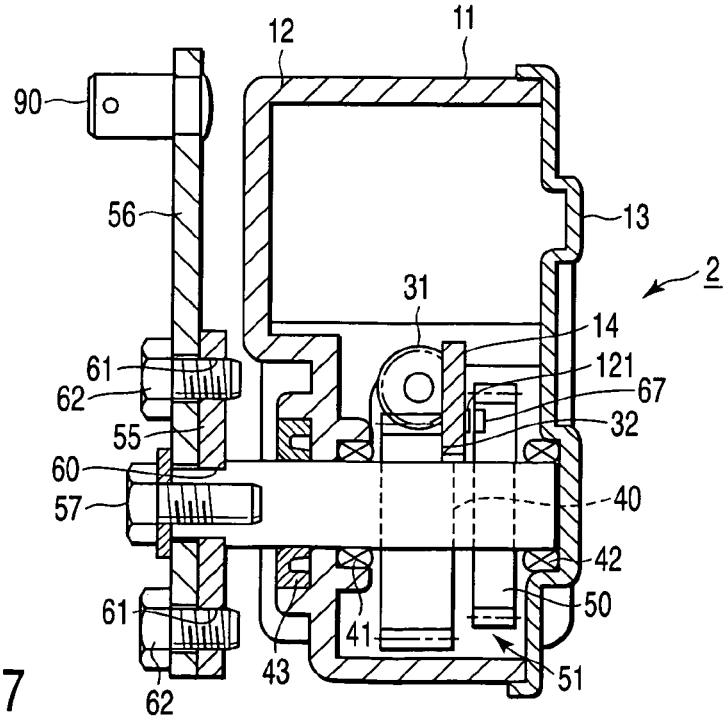
FIG. 7 is a sectional view of the shift operation apparatus for an outboard motor taken along line II-II in FIG. 6.
Figure 8:
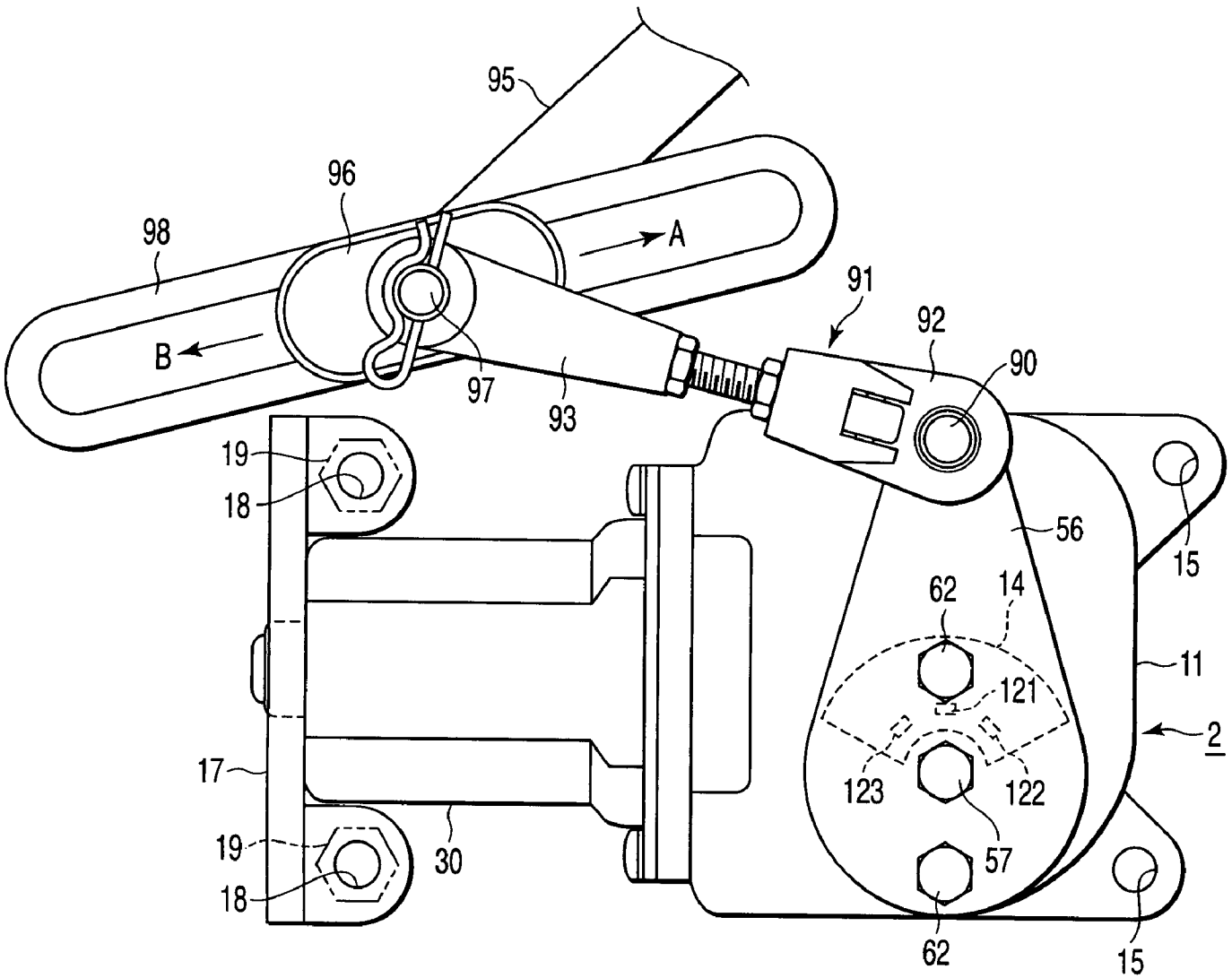
FIG. 8 is a front view when a link rod is attached to the shift operation apparatus for an outboard motor shown in FIG. 1.

FIG. 6 is a side view showing a shift operation apparatus 2 for an outboard motor according to a second embodiment of the present invention, FIG. 7 is a sectional view of the shift operation apparatus 2 for an outboard motor which is taken along line II-II in FIG. 6 and looked in the arrow direction, and FIG. 8 is a front view when a link rod is attached to the shift operation apparatus 2 for an outboard motor. In these drawings, parts which have the same functions as those of FIGS. 1 to 3 described above are denoted by the same reference numerals.

As shown in FIG. 4, the shift operation apparatus 2 for an outboard motor is provided in the vicinity of the outboard motor 20, and has a function of operating the shift mechanism 100 of the outboard motor 20 on the basis of an instruction from the operating lever 111 of the remote control box 110 which will be described later.

As shown in FIG. 6, the shift operation apparatus 2 for an outboard motor has the waterproof structured case 11. The case 11 has the case body 12 and the cover member 13. The mounting holes 15 are formed at the case body 12. The case 11 is located at the inner side of the top cover 21 of the outboard motor 20 (a part thereof is shown in FIG. 4) by the bolts 16 inserted into the mounting holes 15 and the bolts 19 inserted into the mounting holes 18 of the mounting bracket 17 (refer to FIG. 8) attached to the motor 30 as needed.

The waterproof DC motor 30 is provided at the case 11. This motor 30 can be rotated in the first direction and the second direction opposite thereto by switching a direction of electric current. The worm gear 31 is attached to the output shaft of the motor 30. The worm gear 31 is accommodated inside the case 11.

The worm wheel 32 and the first spur gear 33 rotating so as to be integrated with the worm wheel 32 are accommodated inside the case 11. The worm wheel 32 engages with the worm gear 31.

The output shaft 40 is provided so as to freely rotate at the case 11. The bearings 41 and 42 are provided between the case 11 and the output shaft 40. The seal member 43 for waterproofing is provided in the vicinity of the bearing 41.

The second spur gear 50 is attached to the output shaft 40. The second spur gear 50 engages with the first spur gear 33. Because the number of the teeth of the second spur gear 50 is greater than that of the first spur gear 33, the rotation of the first spur gear 33 is transmitted so as to be reduced to the second spur gear 50. These spur gears 33 and 50 form the gear mechanism 51 for transmitting the rotation of the worm wheel 32 to the output shaft 40.

The adjustment plate 55 and the output arm 56 are attached to the output shaft 40. These adjustment plate 55 and output arm 56 are positioned outside the case 11, and prevention of slipping-out of the output shaft 40 is applied thereto by the bolt 57. The output arm 56 can be made to move reciprocally between the shift forward position F and the shift reverse position R with the neutral position N being the boundary as one example is shown in FIG. 6.

The hole 60 formed at the center of the adjustment plate 55 is fitted into the output shaft 40 so as to be unable to rotate. The plurality of tap holes 61 are formed at the adjustment plate 55. These tap holes 61 are formed on the same circle centering around the output shaft 40 at a constant pitch, and the output arm 56 is fixed to the adjustment plate 55 due to the bolts 62 being screwed into a selected pair of selected tap holes 61.

When the bolts 62 are taken off from the tap holes 61, the output arm 56 can be rotated with respect to the adjustment plate 55. When an attempt is made to change the direction of the output arm 56 in accordance with a type of the outboard motor 20, or the like, the bolts 62 are taken off from the tap holes 61, the output arm 56 is made to direct to a desired direction, and thereafter, the output arm 56 is fixed to the adjustment plate 55 due to the bolts 62 being screwed into the tap holes 61.

In accordance therewith, the output arm 56 can be made to direct to the desired direction with respect to the case 11. The arm adjusting mechanism is configured of the adjustment plate 55 having the tap holes 61 and the bolts 62 screwed into the tap holes 61. Note that, as another example of an arm adjusting mechanism, a spline is formed at the output shaft 40, and moreover, a spline slot fitted into the spline may be formed at the output arm 56. In accordance with such a structure as well, a relative position in the direction of rotation of the output arm 56 with respect to the output shaft 40 can be adjusted.

In the interior of the case 11, the third spur gear 65 engages with the second spur gear 50. The fourth spur gear 66 engages with the third spur gear 65. In the interior of the case 11, the microswitch 70 for permitting an engine to start is accommodated. The front end portion of the detecting lever 72 of the microswitch 70 touches the outer peripheral surface of the fourth spur gear 66. A magnet 67 is attached to the second spur gear 50, and it is arranged such that the magnet 67 moves along the circumferential direction in accordance with the rotation of the second spur gear 50. The magnet 67 has a function of turning each facing Hall IC on when the magnet 67 faces and approaches to a shift neutral position Hall IC 121, a shift forward position Hall IC 122, and a shift reverse position Hall IC 123.

When the output arm 56 is positioned at the neutral position N, the front end portion of the detecting lever 72 enters the concave portion 73 formed at the fourth spur gear 66, whereby the microswitch 70 is turned on. When the microswitch 70 is turned on, the signal thereof is output to the control circuit 80 (refer to FIG. 5), whereby starting of the engine 82 by the starter switch 81 is permitted. The control circuit 80 and the sift operation apparatus 2 are connected to one another via the electric cable 83. The electric cable 84 connected to the control circuit 80 is cabled between the hull (not shown) and the outboard motor 20.

When it is detected by the shift forward position Hall IC 122 that the output arm 56 has moved up to the shift forward position F, the motor 30 is stopped by the control circuit 80. When it is detected by the shift reverse position Hall IC 123 that the output arm 56 has moved up to the shift reverse position R as well, the motor 30 is stopped.

As shown in FIG. 8, the one end 92 of the link rod 91 is connected to the pin 90 provided at the output arm 56. The other end 93 of the link rod 91 is connected to the end portion 96 of the shift lever 95 serving as a portion to be operated, by means of the pin 97. The end portion 96 of the shift lever 95 can move along the shift rail 98 in the directions shown by arrows A and B in FIG. 8, and when the end portion 96 of the shift lever 95 moves in arrow A, the shift mechanism 100 (refer to FIG. 5) is switched to the forward position, and when the end portion 96 of the shift lever 95 moves in arrow B, the shift mechanism 100 is switched to the reverse position.

The operating lever 111 of the remote control box 110 (refer to FIG. 5) provided at a pilothouse or the like can be made to move up to the full throttle position (limit position) at the forward side via the shift forward position F from the neutral position N. Further, the operating lever 111 can be made to move up to the full throttle position (limit position) at the reverse side via the shift reverse position R from the neutral position N.

The position of the operating lever 111 is detected by the potentiometer 112. When the operating lever 111 moves up to the shift forward position F, the motor 30 of the shift operation apparatus 2 is rotated in the first direction by a signal output by the control circuit 80. In accordance therewith, the output arm 56 moves up to the forward position F. When the operating lever 111 moves up to the shift reverse position R, the motor 30 rotates in the second direction, the output arm 56 moves up to the reverse position R.

Figure 9:
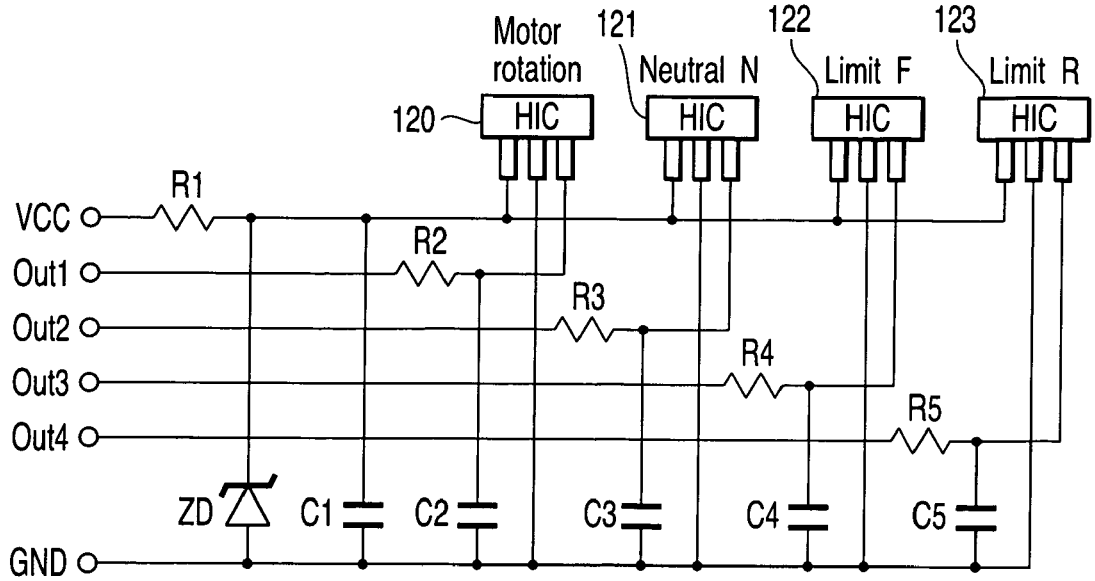
FIG. 9 is a circuit diagram of respective Hall ICs.

As shown in FIG. 8, the shift neutral position Hall IC 121, the shift forward position Hall IC 122, and the shift reverse position Hall IC 123 are attached to a built-in substrate 14 of the case 11. FIG. 9 is a diagram showing connection circuits of the Hall ICs 120 to 123. As shown in FIG. 9, a power source VCC is connected to the power terminals of the respective Hall ICs 120 to 123 via a resistance R1. The ground terminals of the respective Hall ICs 120 to 123 are respectively connected to a ground terminal GND via capacitors C1 to C5.

The motor rotating quantity detecting Hall IC 120 for detecting the number of revolutions of the motor 30 is connected to an output terminal Out1 via a resistance R2.

Figure 10:
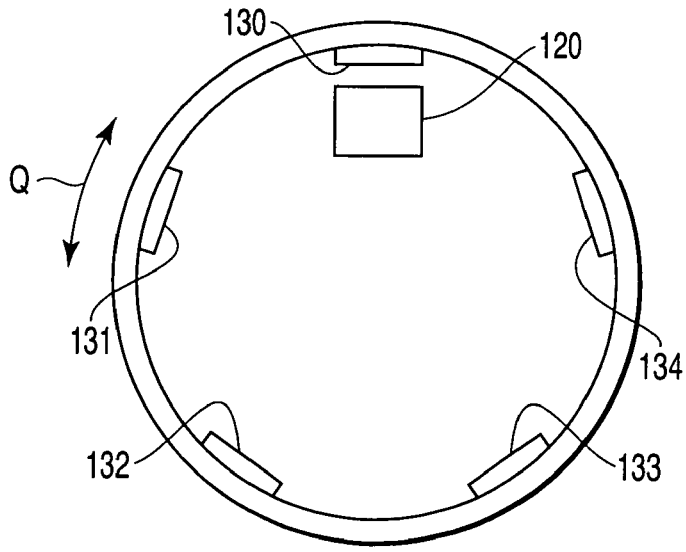
FIG. 10 is an explanatory diagram showing a layout of a rotating quantity detecting Hall ICs.
Figure 11:
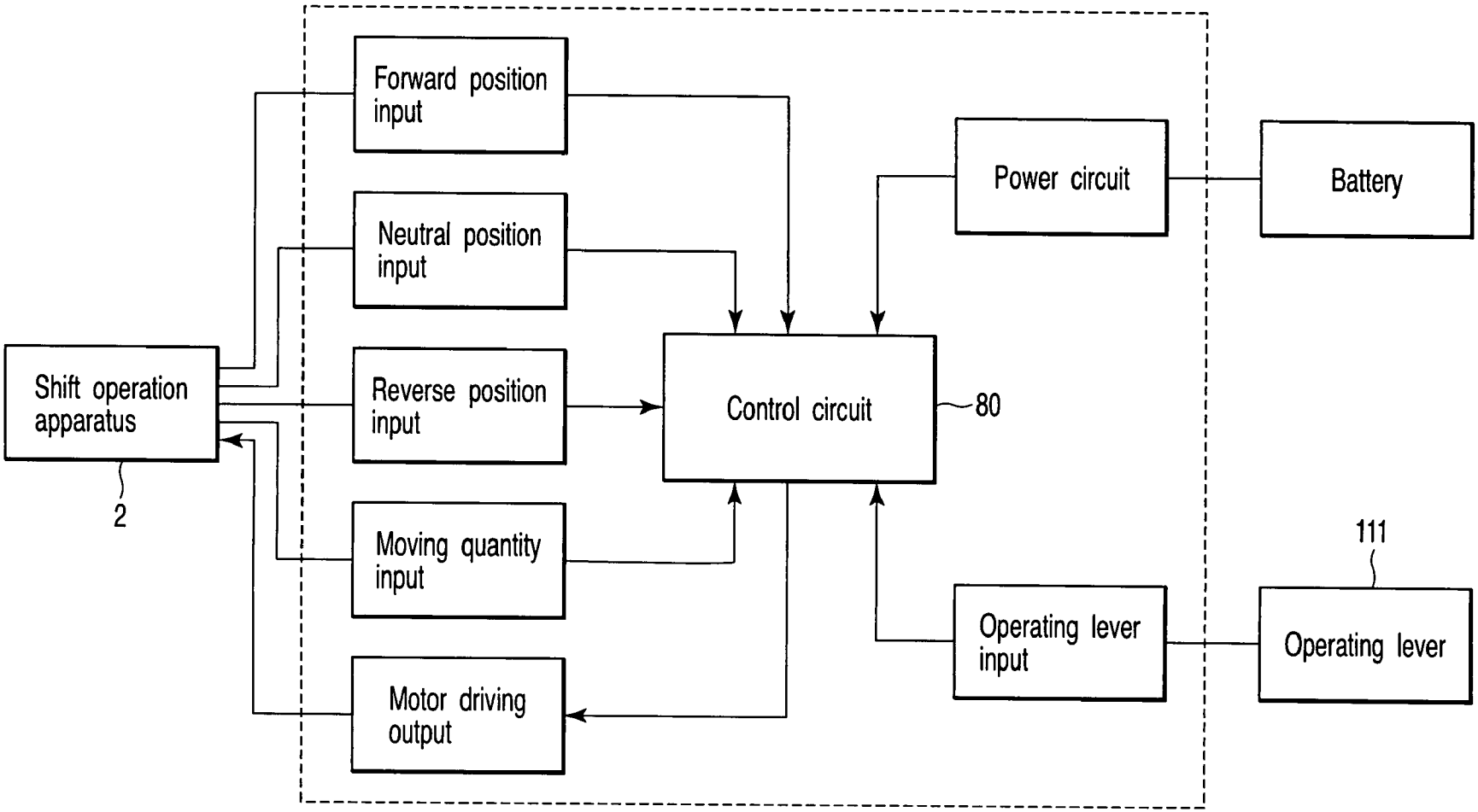
FIG. 11 is a block diagram showing the flow of a control signal.
Figure 12:
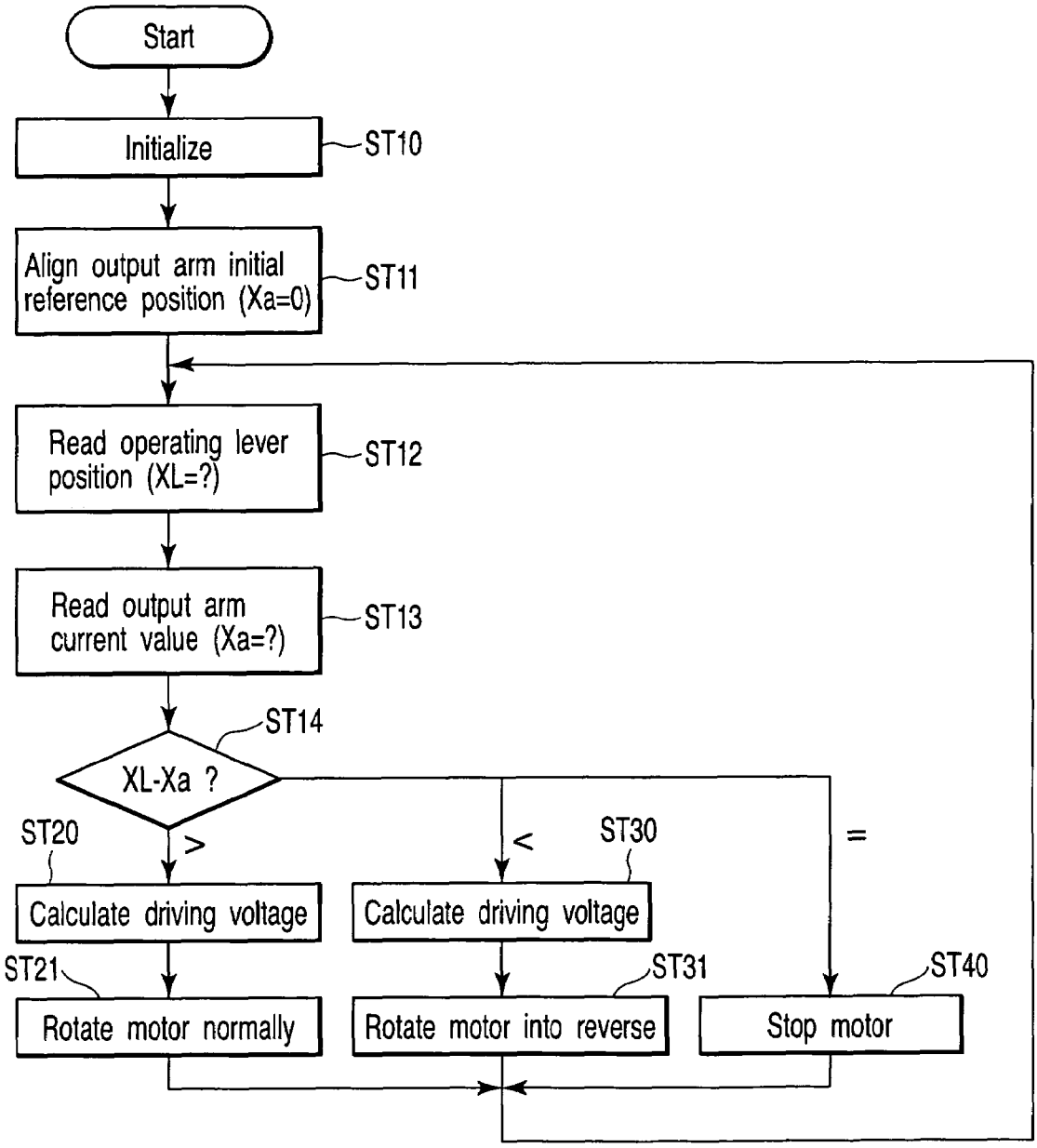
FIG. 12 is an explanatory diagram showing the control flow.

The motor rotating quantity detecting Hall IC 120 is provided in the motor 30, and as shown in FIG. 10, five magnets 124 to 128 are arranged at the surroundings thereof, and are provided so as to rotate in the directions of arrow Q in accordance with the rotation of the motor 30. Namely, the five magnets 124 to 128 rotate in accordance with the rotation of the motor 30, and a pulse signal is output from the motor rotating quantity detecting Hall IC 120 in accordance with the proximity of these magnets 124 to 128.

The neutral position Hall IC 121 for detecting the neutral position N of the output arm 56 is connected to an output terminal Out2 via a resistance R3. The neutral position Hall IC 121 is provided so as to face the rotational position of the magnet 67 at the time when the output arm 56 is positioned at the neutral position N.

The shift forward position Hall IC 122 for showing the shift position at the forward side is connected to an output terminal Out3 via a resistance R4. The shift forward position Hall IC 122 is provided so as to face the rotational position of the magnet 67 at the time when the output arm 56 is positioned at the shift forward position F.

The shift reverse position Hall IC 123 for showing the shift position at the reverse side is connected to an output terminal Out4 via a resistance R5. The shift reverse position Hall IC 123 is provided so as to face the rotational position of the magnet 67 at the time when the output arm 56 is positioned at the shift reverse position R.

The shift operation apparatus 2 configured in this way is actuated as follows. First, initialization (ST10) is carried out at the same time of turning the power source on. When the operating lever 111 of the remote control box 110 is positioned at the neutral position N, the motor 30 of the shift operation apparatus 2 is being stopped. At that time, the output arm 56 is positioned at the neutral position N. Next, the output arm 56 is made to move up to the neutral position N by rotating the motor 30. Due to the motor 30 being stopped when the second spur gear 50 rotates, and the magnet 67 faces the neutral position Hall IC 121 and is made to be on, Xa is made to be 0 by carrying out initial reference registering of the output arm (ST11).

The operating lever 111 of the remote control box 110 is made to move up to the shift forward position F. A position XL of the operating lever 111 at this time is read by the control circuit 80 (ST12). The motor 30 of the shift operation apparatus 2 rotates in the first direction on the basis of a signal output by the potentiometer 112 in accordance with the position of the operating lever 111, and the output arm 56 moves to the shift forward position F side via the first spur gear 33 and the second spur gear 50. In accordance therewith, the end portion 96 of the shift lever 95 moves in the direction of arrow A in FIG. 8 via the link rod 91, and the shift mechanism 100 enters the forward position.

In a series of these operations, misregistration between the position XL of the operating lever 111 and the position Xa of the output arm 56 is eliminated as follows. Namely, a quantity of movement of the output arm 56 is calculated by the rotating quantity of the motor 30, and the actual position Xa of the output arm 56 is read by the control circuit 80 (ST13).

Next, a difference between the position XL of the operating lever 111 and the position Xa of the output arm 56 is calculated (ST14). When the finite difference thereof is positive, because the quantity of movement of the output arm 56 is insufficient, a driving voltage for normally rotating the motor 30 is calculated (ST20), and the motor 30 is normally rotated (ST21). Further, the routine returns to ST12, and the same operations are repeated.

On the other hand, when the finite difference thereof is negative, because the quantity of movement of the output arm 56 is excessive, a driving voltage for rotating the motor 30 into reverse is calculated (ST30), and the motor 30 is rotated into reverse (ST31). Further, the routine returns to ST12, and the same operations are repeated.

Further, when the finite difference thereof is 0, because the quantity of movement of the output arm 56 is normal, the motor 30 is made to stop (ST40). Then, the routine returns to ST12, and the same operations are repeated.

When the output arm 56 has completed moving up to the forward position F shown by the operating lever 111, because the motor 30 is stopped, the shift mechanism 100 is maintained at the forward position.

Note that, because the quantity of movement of the output arm 56 is determined by the rotating quantity of the motor 30, the quantity of movement of the output arm 56 is detected by counting the outputs of pulses from the motor rotating quantity detecting sensor 120.

When the operating lever 111 of the remote control box 110 is made to further move forward from the shift forward position F, a throttle mechanism (not shown) of the engine 82 is actuated to the accelerating side on the basis of a signal output by the control circuit 80 from the potentiometer 112.

When the operating lever 111 of the remote control box 110 is made to move up to the shift reverse position R, the motor 30 rotates in the second direction on the basis of a signal output by the potentiometer 112, and the output arm 56 moves up to the shift reverse position R via the first spur gear 33 and the second spur gear 50.

In accordance therewith, the end portion 96 of the shift lever 95 moves in the direction of arrow B in FIG. 8 via the link rod 91, and the shift mechanism 100 enters the reverse position. When the output arm 56 has completed moving up to the reverse position R, because the motor 30 is stopped in the same way as in the forward case described above, the shift mechanism 100 is maintained at the reverse position.

The operating lever 111 of the remote control box 110 is made to further move into reverse from the shift reverse position R, a throttle mechanism (not shown) of the engine 82 is actuated to the accelerating side on the basis of a signal output by the control circuit 80 from the potentiometer 112.

Note that, provided that a quick release type pole joint which can be attached and detached is used as the connecting portion of the output arm 56 and the link rod 91, it is possible to carry out shift operation by detaching the pole joint at the time of the failure of the motor 30, or the like, and manually operating the link rod 91.

Because the position sensor using these Hall ICs 120 to 123 is more compact as compared with a case in which a potentiometer is built into the case 11, the shift operation apparatus 2 can be configured to be compact, which facilitates the building the shift operation apparatus 2 into the outboard motor 20. Note that the shift forward position Hall IC 122 and the shift reverse position Hall IC 123 can prevent the motor 30 from being overheated by detecting the limit position of the output arm 56 and stopping the motor 30 when the rotating quantity detecting Hall IC 120 is broken down due to some cause.

As described above, in accordance with the shift operation apparatus 2 for an outboard motor according to the second embodiment of the present invention, a shift position of the output arm 56 connected to the shift mechanism 100 of the outboard motor is precisely detected by the motor rotating quantity detecting Hall IC 120 in the motor 30 which is a sensor arranged in the vicinity of the outboard motor, and further, a quantity of misregistration thereof with the operating lever 111 is corrected, whereby the shift position of the operating lever 111 and the shift position of the shift mechanism 100 can be precisely matched to each other. Further, because the position of the output arm 56 is detected by the motor rotating quantity detecting Hall IC 120 in the motor 30, the apparatus can be made smaller as compared with a case in which a potentiometer is used.

Figure 13:
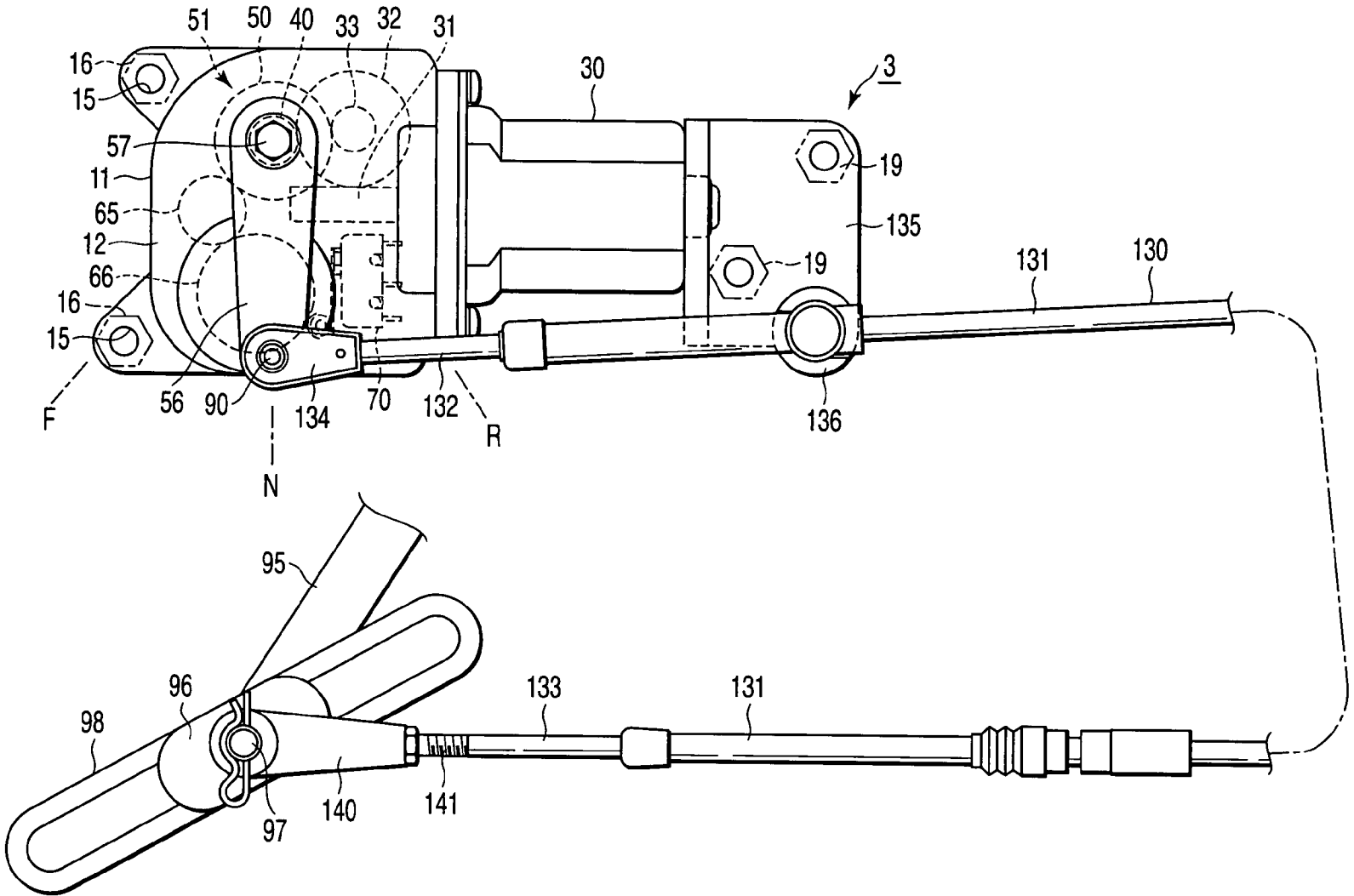
FIG. 13 is a front view of a shift operation apparatus for an outboard motor showing a third embodiment of the present invention.
Figure 14:
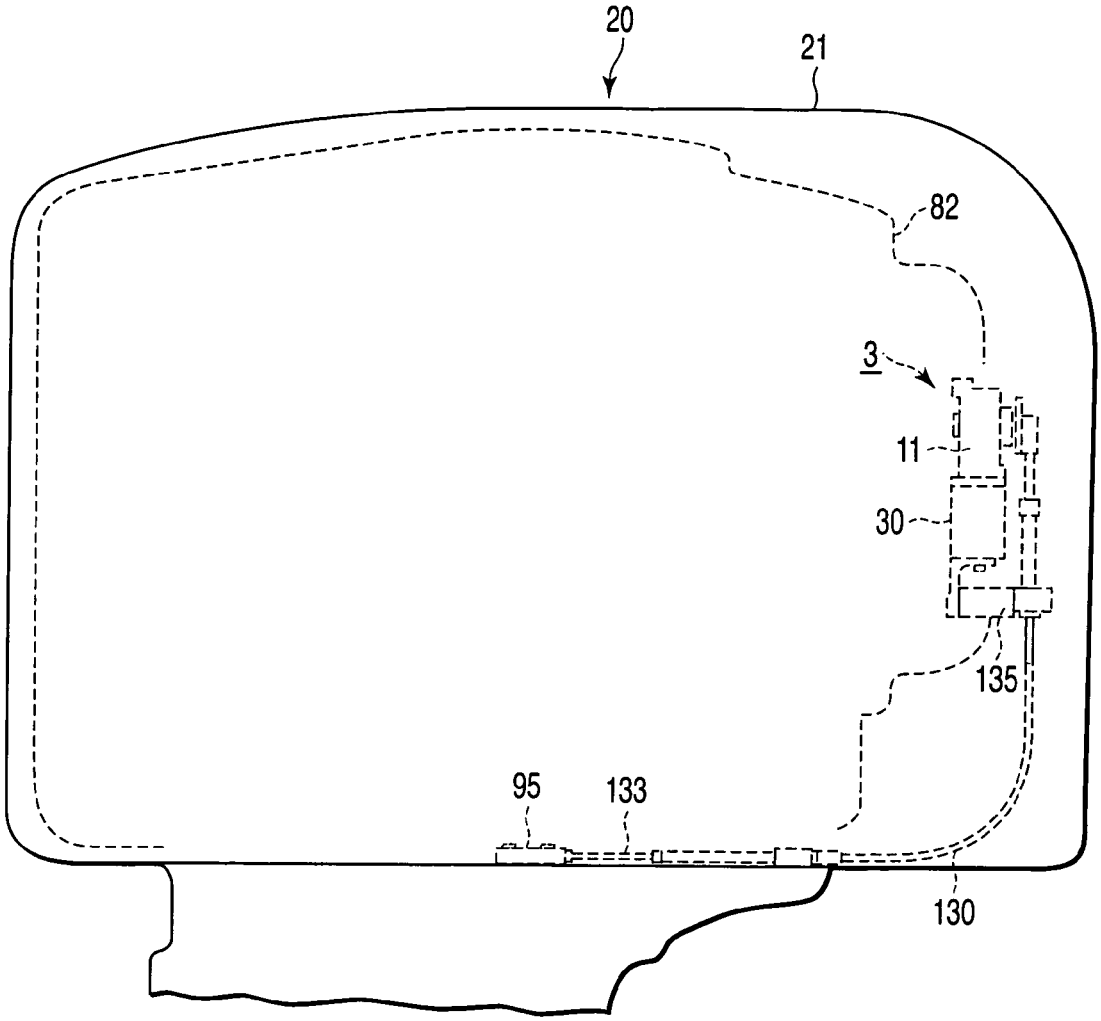

FIGS. 13 and 14 illustrate a shift operation apparatus 3 for an outboard motor according to a third embodiment of the present invention. This shift operation apparatus 3 for an outboard motor is attached to the engine 82 in the interior of the top cover 21 of the outboard motor 20. The shift operation apparatus 3 and the end portion 96 of the shift lever 95 are connected to each other via a push pull cable 130. The push pull cable 130 is cabled inside the top cover 21 of the outboard motor 20.

The push pull cable 130 has an outer tube 131, an inner cable (not shown) inserted into the inside of the outer tube 131, cable rods 132 and 133 connected to the both ends of the inner cable, and the like. A cable end 134 provided at the one cable rod 132 is connected to the output arm 56. The outer tube 131 is supported by a holding portion 136 of a bracket member 135 fixed to the motor 30. The output arm 56 is directly fixed to the output shaft 40.

Note that, provided that a quick release type pole joint which can be attached and detached is used as the connecting portion of the output arm 56 and the cable end 134, it is possible to carry out shift operation by detaching the pole joint at the time of the failure of the motor 30 and manually operating the cable end 134.

A cable end 140 provided at the other cable rod 133 is connected to the end portion 96 of the shift lever 95. In the present embodiment, a relative position of the cable end 140 with respect to the outer tube 131 can be adjusted due to the cable end 140 being rotated with respect to a threaded portion 141 of the push pull cable 130.

Because the configuration and the effect, which are other than those of the above description, of the shift operation apparatus 3 of the third embodiment is in the same way as those of the shift operation apparatus 1 of the first embodiment, portions which are common to the both are denoted by the same reference numerals, and descriptions thereof will be omitted.

When these embodiments and other examples of the present invention are implemented, it goes without saying that the components of the present invention, such as a case, a motor, a worm gear and a worm wheel, an arm, a sensor, a force transmitting member, or the like can be variously modified and implemented within a range which does not deviate from the gist of the present invention.

Figure 15:
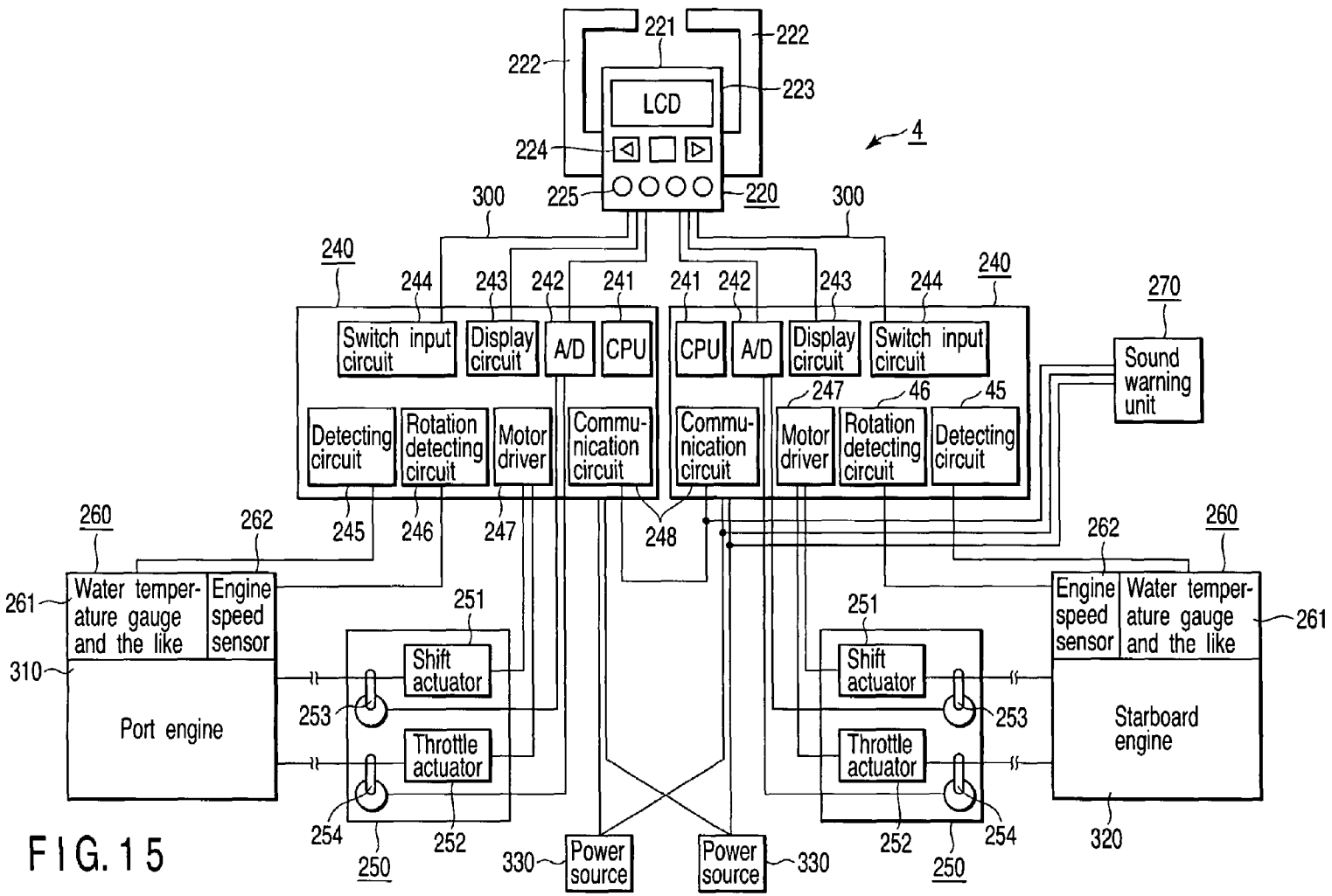
FIG. 15 is block diagram showing a configuration of an electronic remote control apparatus for a medium-sized ship according to a fourth embodiment of the present invention.
Figure 16:
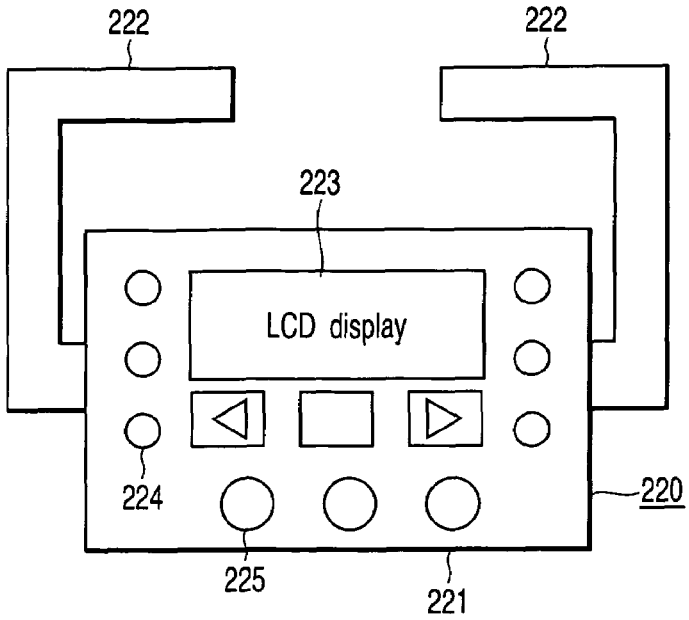
FIG. 16 is a front view showing a control head built in the electronic remote control apparatus for a medium-sized ship.
Figure 17:
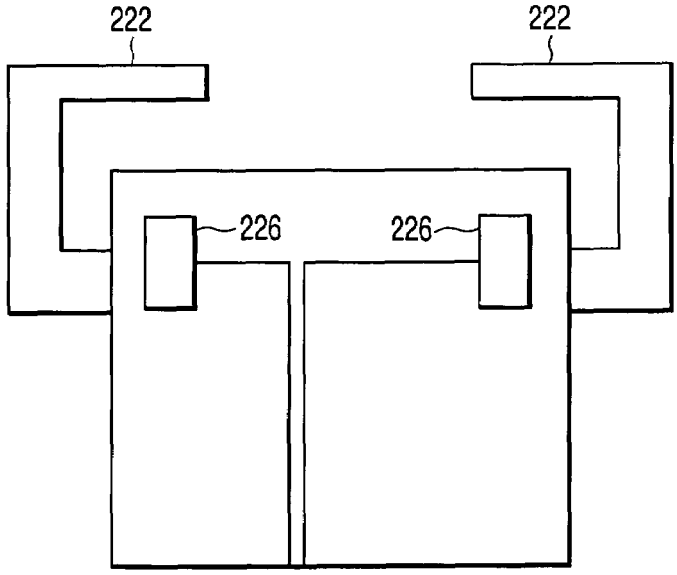
FIG. 17 is a block diagram showing a configuration of the control head.
Figure 18:
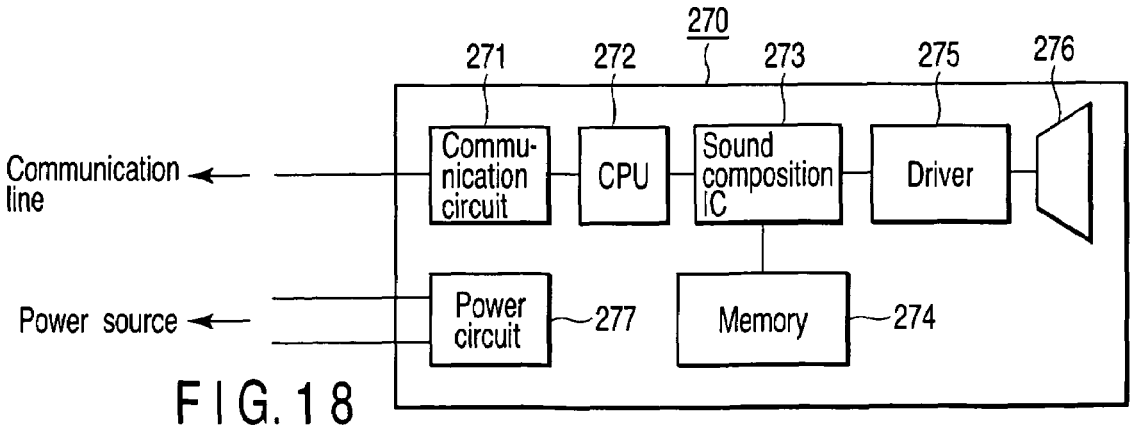
FIG. 18 is a block diagram showing a configuration of a sound warning unit built in the electronic remote control apparatus for a medium-sized ship.
Figure 19:
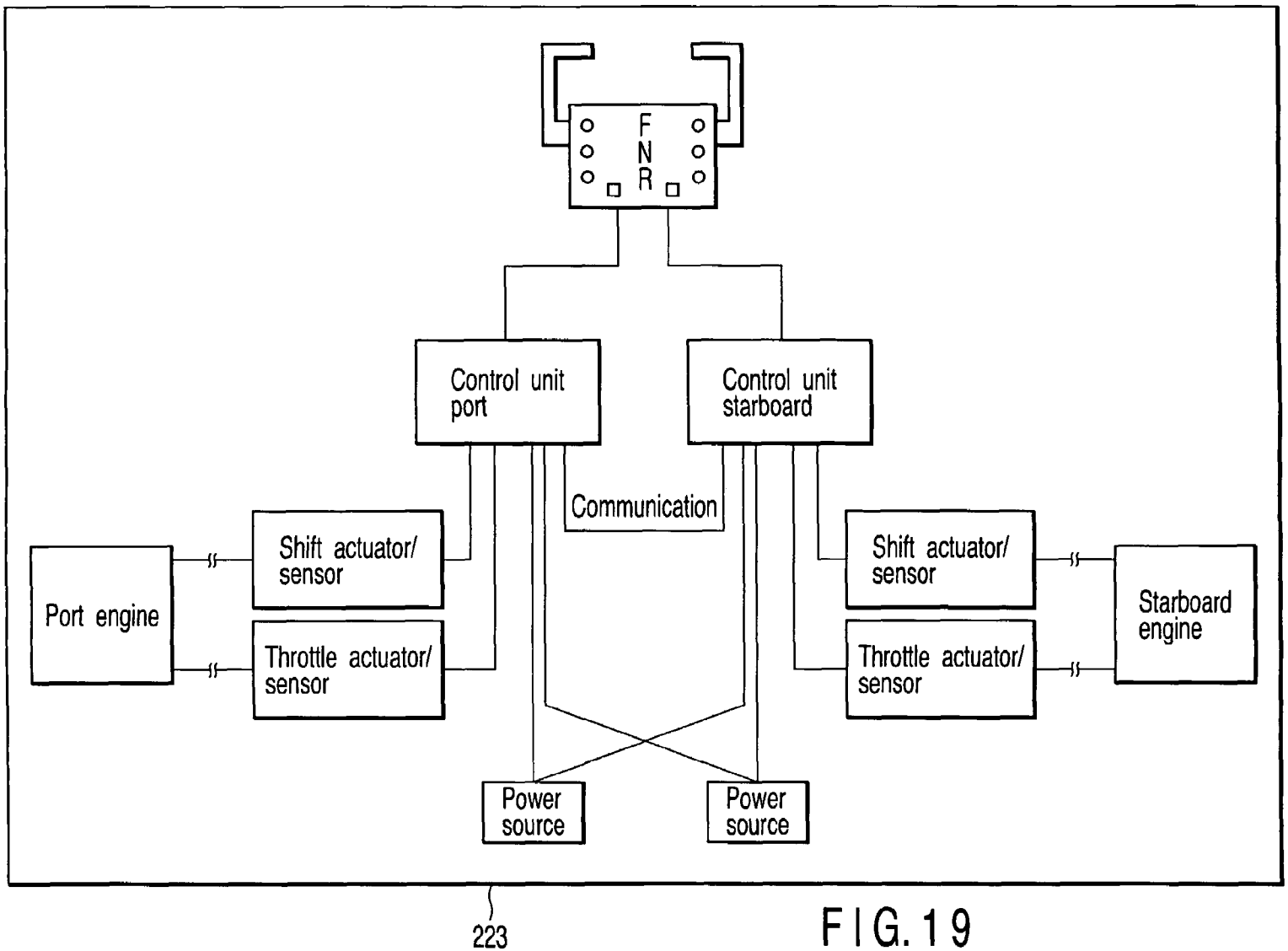
FIG. 19 is an explanatory diagram showing one example of a display screen displayed on a liquid-crystal display unit built in the electronic remote control apparatus for a medium-sized ship.

FIG. 15 is a block diagram showing a configuration of an electronic remote control apparatus 4 for a medium-sized ship according to a fourth embodiment of the present invention, FIG. 16 is a front view showing a control head 220 built into the electronic remote control apparatus 4 for a medium-sized ship, FIG. 17 is a block diagram showing a configuration of the control head 220, FIG. 18 is a block diagram showing a configuration of a sound warning unit 270 built into the electronic remote control apparatus 4 for a medium-sized ship, and FIG. 19 is an explanatory diagram showing one example of a display screen displayed on a liquid-crystal display unit 223 built in an electronic remote control apparatus 4 for a medium-sized ship.

The electronic remote control apparatus 4 for a medium-sized ship has the control head 220 which is arranged in the pilothouse and a helmsman operates, a pair of control units 240, 240 connected to the control head 220 by remote control harnesses 300, a pair of driving units 250, 250 for driving the shift levers and the throttle levers of a port engine 310 and a starboard engine 320 on the basis of driving signals from these control units 240, 240, a pair of sensor units 260, 260 for detecting the states of the port engine 310 and the starboard engine 320, and the sound warning unit 270 for carrying out warning by sounds at the time of being unusual. Note that, in FIG. 15, reference numeral 300 denotes a remote control harness, reference numeral 310 denotes a port engine (engine), reference numeral 320 denotes a starboard engine (engine), and reference numeral 330 denotes a power source such as a battery or the like.

The control head 220 has a housing 221 as shown in FIG. 16. At the housing 221, a pair of left and right operating levers 222, the liquid crystal display unit 223 on which character information and graphic information can be displayed, an LED unit 224 showing forward movement/neutrality/reverse movement, and operating switches 225 for inputting various information (the PUSH/PULL polarity and the stroke of the shift, the PUSH/PULL polarity and the stroke of the throttle, and the like) are provided. In the interior of the housing 221, potentiometers 226 for detecting the operating positions of the operating levers 222 are provided.

The control unit 240 has a CPU 241 for carrying out the entire control, an A/D converting unit 242 for carrying out A/D conversion of signals, a display circuit 243 for controlling displays of the liquid crystal display unit 223 and the LED unit 224, a switch input circuit 244 to which a signal from the control head 220 is input, a detecting circuit 245 to which a signal from a water temperature gauge 261 which will be described later is input, and in which an unusual portion is determined, a rotation detecting circuit 246 for determining an unusual portion due to an engine speed signal being input from an engine speed sensor 262 which will be described later, a motor driver 247 for driving an actuator of the driving unit 250, and a communication circuit 248 for carrying out interchange of signals with the other side control unit 240. The control unit 240 is supplied with electric current from the power source 330.

The driving unit 250 has a shift actuator 251 connected to a shift arm for determining the forward movement/reverse movement of the port engine 310 and the starboard engine 320, a throttle actuator 252 connected to a throttle arm for determining the thrust, potentiometers 253, 254 for detecting the positions of the shift actuator 251 and the throttle actuator 252.

The sensor unit 260 has the water temperature gauge 261 and the engine speed sensor 262. Note that sensors are not limited thereto. Further, the sensors may be provided at the control head 220, the control unit 240, and the driving unit 250.

As shown in FIG. 18, the sound warning unit 270 has a communication circuit 271 connected to the communication circuit 248 of the control unit 240, a CPU 272 for carrying out the entire control, a sound composition IC 273 for generating an unusual state as a sound signal, a memory 274 for storing sound contents, a driver 275 for amplifying the sound signal generated by the sound composition IC 273, and a speaker 276 for outputting the sound signal amplified by the driver 275 as sounds. Note that, in FIG. 18, reference numeral 277 denotes a power circuit connected to the power source 330, for supplying electric power to the respective units.

In the electronic remote control apparatus 4 for a medium-sized ship configured in this way, the angular position thereof is detected by the potentiometer 226 by operating the pair of left and right operating levers 222. Then, a detection signal is input to the control unit 240 via the remote control harness 300. The input detection signal is digitized by the A/D converting circuit 242, the driven quantity is calculated by the CPU 241, and a driving signal is output to the driving unit 250 from the motor driver 247.

In the driving unit 250, the shift actuator 251 and the throttle actuator 252 are actuated by the driving signal, and the shift arms and the throttle arms of the port engine 310 and the starboard engine 320 are operated, whereby the shipping operation is carried out. Note that the operating situations of both of the pair of left and right control units 240, 240 are interchanged by communication via the communication harnesses, and the balance of the shipping operation is maintained.

Next, a case in which an unusualness has arisen will be described. For example, in the port engine 310, when an unusualness that a water temperature rises occurs, a water temperature is detected at the detecting circuit 245 to which water temperature data is being always transmitted from the water temperature gauge 261. When the water temperature is made higher than a predetermined value, it is determined as an unusualness in a water temperature at the detecting circuit 245, and an alarm signal is transmitted to the control head 220 via the display circuit 243. At the control head 220, the display circuit 243 is driven on the basis of the alarm signal, and at the same time when the unusualness in a water temperature is reported by character information on the liquid crystal display unit 223, the unusualness in a water temperature is notified to the helmsman by making the port engine flicker (refer to FIG. 19).

On the other hand, the alarm signal is input to the sound warning unit 270 via the communication harness, the sound corresponding thereto is read from the memory 274 on the basis of the alarm signal, and a sound signal is generated by the sound composition IC 273. The sound signal is output such as the sound of "the water temperature at the port engine is unusual" or the like to the helmsman from the speaker 276 via the driver 275.

In addition thereto, when an unusualness occurs at the control head 220, the control unit 240, and the driving unit 250 as well, it is possible to detect the occurrence of the unusualness by detecting a sensor and an unusualness in signal. For example, when an unusualness occurs at the control head 220, it is possible to detect the occurrence of the unusualness when an operation signal (a digital signal) is not transmitted thereto, or when an operation signal (an analog signal) is not within a regular voltage range. Namely, it is possible to determined that it is unusual due to the operation signal being not normally received at the control unit 230.

In this way, in accordance with the electronic remote control apparatus 4 for a medium-sized ship according to the fourth embodiment of the present invention, even when an unusualness occurs at the port engine 310 or the starboard engine 320 which is away from the helmsman, a notification of the unusualness and a notification of an unusual portion can be carried out on the liquid crystal display 223 of the control head 220, and sounds are generated from the speaker 276. Therefore, the helmsman can immediately know the occurrence of the unusualness and the unusual portion even without referring to a manual or the like, and can quickly carry out the appropriate measures.

Figure 20:
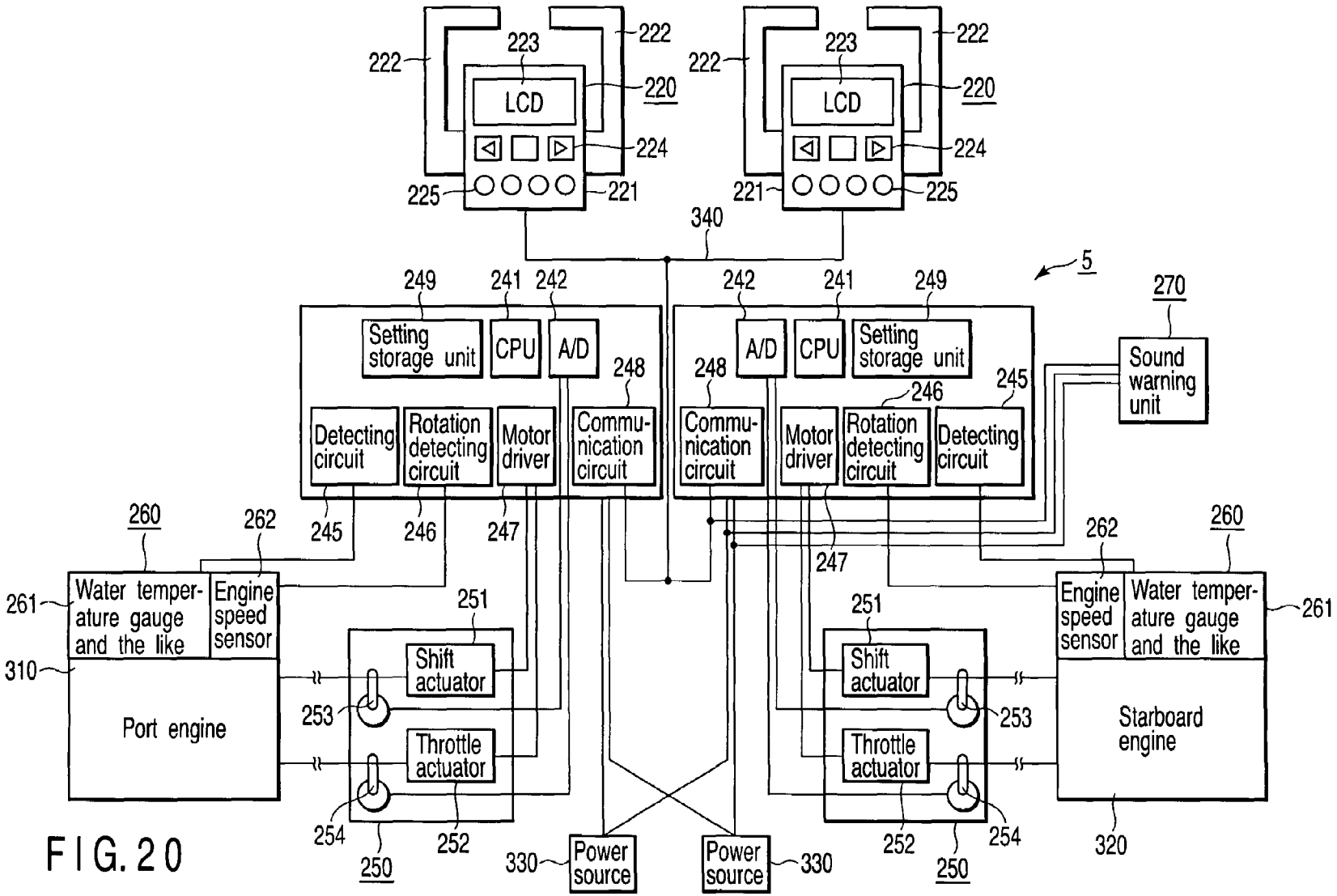
FIG. 20 is a block diagram showing a configuration of an electronic remote control apparatus for a medium-sized ship according to a fifth embodiment of the present invention.

FIG. 20 is a diagram showing an electronic remote control apparatus 5 for a medium-sized ship according to a fifth embodiment of the present invention. Note that portions in FIG. 20 which have the same functions as those of FIG. 15 are denoted by the same reference numerals, and detailed descriptions thereof will be omitted.

Two of the control heads 220 are mounted on the electronic remote control apparatus 5 for a medium-sized ship. The control heads 220, the control units 240, and the sound warning unit 270 are connected via a LAN (local area network) 340, and an inboard LAN system is configured thereby. Note that the LAN 340 may be configured by any of wires and wireless (infra-red radiation, radio wave, ultrasonic wave, and the like).

The control head 220 has the housing 221 as shown in FIG. 16. In the housing 221, the pair of left and right operating levers 222, the liquid crystal display unit 223 on which character information and graphic information cab be displayed, an LED unit 224 showing forward movement/neutrality/reverse movement, and operating switches 225 for inputting various information (the PUSH/PULL polarity and the stroke of the shift, the PUSH/PULL polarity and the stroke of the throttle, and the like) are provided.

Figure 21:
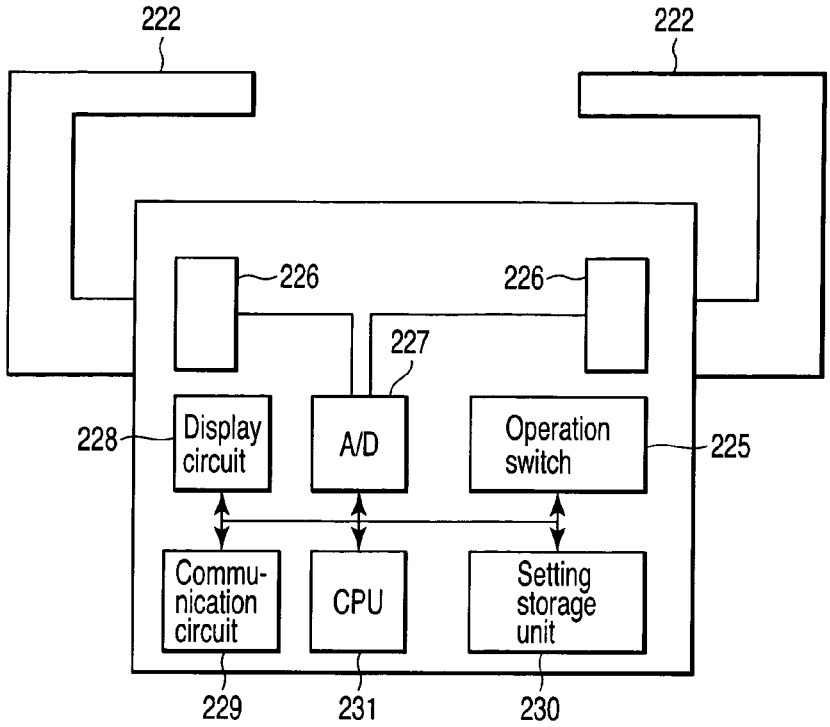
FIG. 21 is a block diagram showing a configuration of a control head built in the electronic remote control apparatus for a medium-sized ship.

In the interior of the housing 221, as shown in FIG. 21, the potentiometers 226 for detecting the operating positions of the operating levers 222, the A/D converting circuit 227 for A/D converting a signal from the potentiometer 226, a display circuit 228 for controlling the liquid crystal display unit 223 and the LED unit 224, a communication circuit 229 for carrying out the input/output of signals with the control unit 240, a setting storage unit 230 configured of a setting switch or a nonvolatile memory, and a CPU 231 for controlling these respective units are provided.

Identification numbers which are specific to the respective control heads 220 are stored in the setting storage unit 230 of the control head 220, and when an operation signal is output, an identification number is denoted thereto, and the signal is transmitted. Further, the order of precedence of the identification numbers has been determined, and when the two control heads 220 carry out operations which are contrary to each other, it can be determined in advance which is the control head 220 from which an operation signal made to be prefer to the other operation signal is.

The communication circuit 229 of the control head 220 is connected to the communication circuits 248, 248 of the left and right control units 240, 240 via the LAN 340. A setting storage unit 249 for setting the PUSH/PULL polarity and the stroke of the shift, the PUSH/PULL polarity and the stroke of the throttle, and the like, is provided at the control unit 240.

In the setting storage unit 249, for example, in addition to the method in which setting is carried out by dip switches of 8 poles×4 pieces, a setting may be stored in a nonvolatile memory by carrying out setting operation from the control head 220. By storing the setting information of the shift and the throttle described above in the control unit 240, even when the control heads 220 are replaced with one another, there is no need to carry out setting.

In addition thereto, when a nonvolatile memory is used in the setting storage unit 249, a diagnosed result at the time of occurring an unusualness may be stored, and the diagnosed result may be referred at the time of maintenance.

Note that the control heads 220 may be further increased, and different identification numbers are denoted thereto.

In this way, in accordance with the electronic remote control apparatus 5 for a medium-sized ship according to the fifth embodiment of the present invention, the same effect as in the electronic remote control apparatus 4 for a medium-sized ship can be obtained, and by using the LAN 340, an attempt can be made to make the control unit 240 smaller as compared with the case in which the remote control harnesses are used. Even if more control heads 220 are used, it suffices to set ID numbers of the additional heads in the setting storage unit 230 and to connect the additional heads to the LAN 340. This can reduce the number of installation steps.

Figure 24:
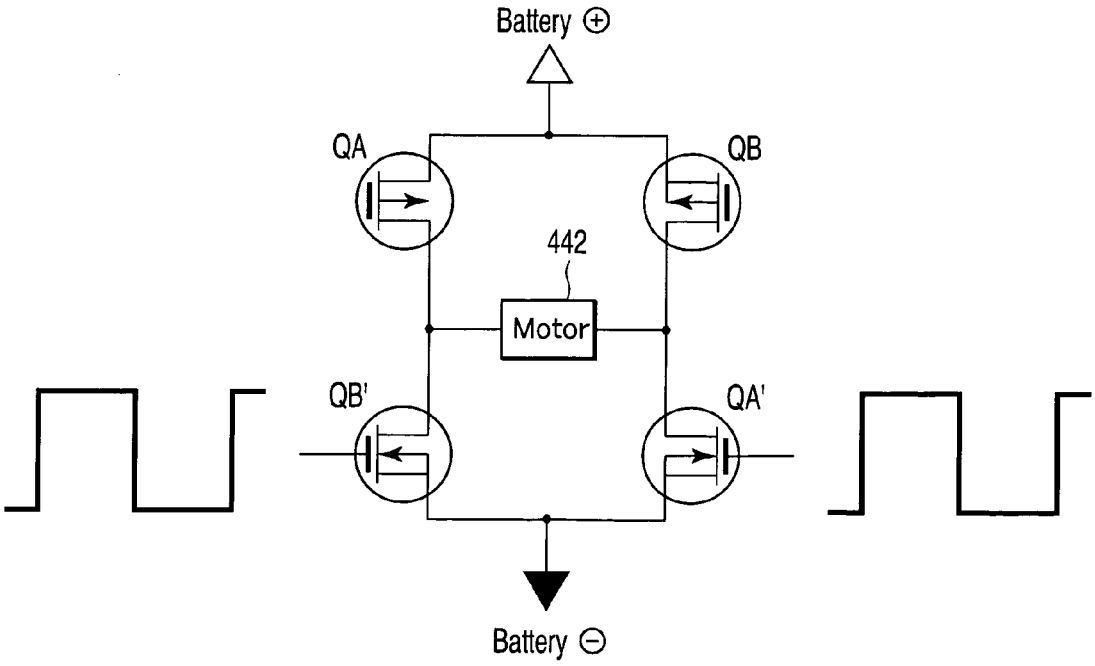
FIG. 24 is an explanatory diagram showing the principle of operation of a control circuit built in the control unit.
Figure 22:
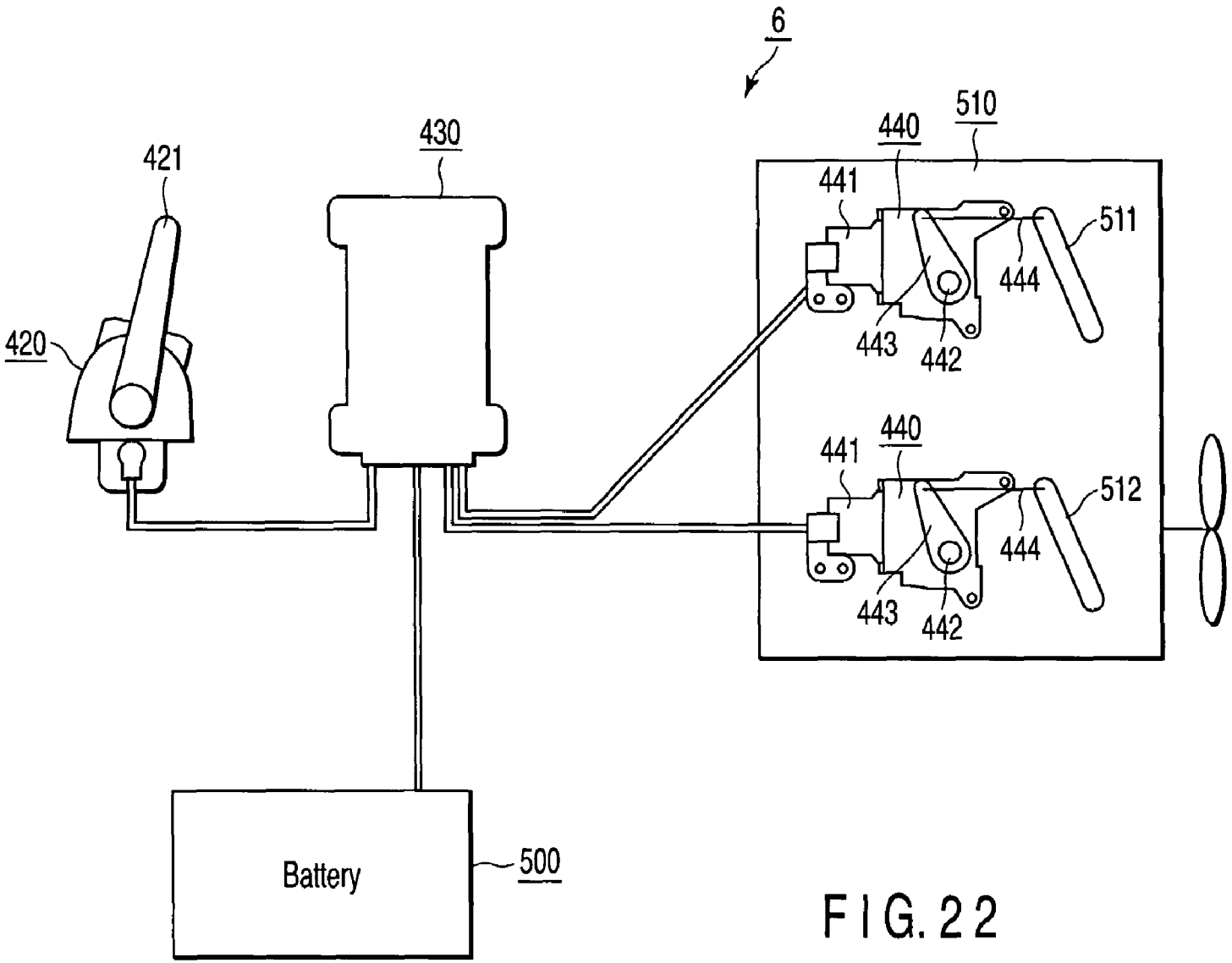
FIG. 22 is an explanatory diagram showing a configuration of an engine control apparatus according to a sixth embodiment of the present invention.
Figure 23:
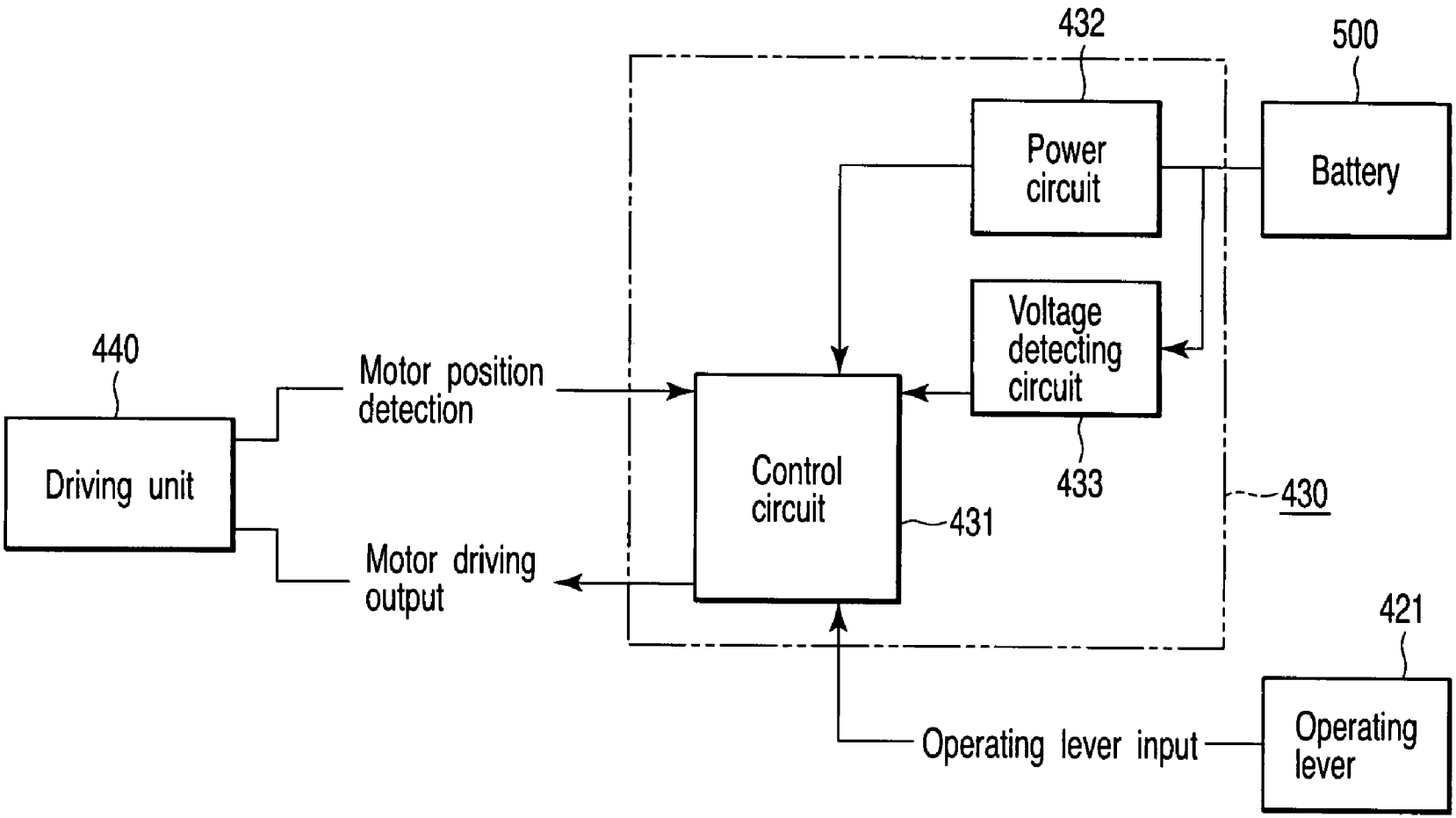
FIG. 23 is a block diagram showing a control unit built in the engine control apparatus.
Figure 25:
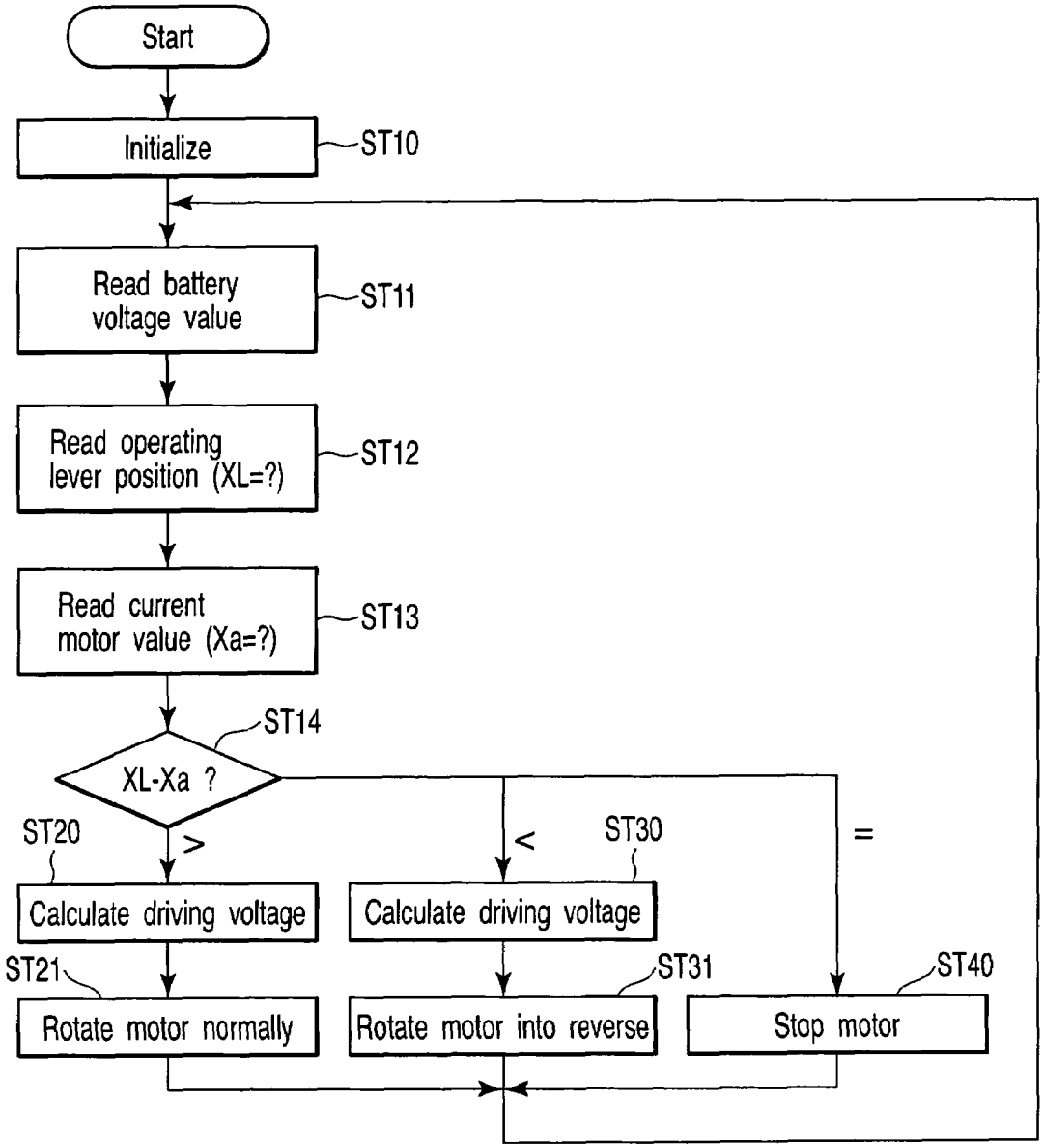
FIG. 25 is an explanatory diagram showing the flow of the operational of the engine control apparatus.

FIG. 22 is a schematic diagram showing a configuration of an engine control apparatus 6 for a medium-sized ship according to a sixth embodiment of the present invention, FIG. 23 is a block diagram showing a configuration of the engine control apparatus 6, FIG. 24 is an explanatory diagram showing the principle of operation of a control circuit 431 built in the engine control apparatus 6, and FIG. 25 is an explanatory diagram showing the flow of operations.

The engine control apparatus 6 has an operating unit 420 for outputting an operation signal by carrying out operations of forward movement/reverse movement or the like by a helmsman, a control unit 430 connected to the operating unit 420, for applying driving electric power to a driving unit on the basis of an operation signal, and a pair of driving units 440 which are connected to the control unit 430 and which are actuated by the driving electric power. Note that, in FIG. 22, reference numeral 500 denotes a battery of 12V or 24V, and reference numeral 510 denotes an outboard motor.

The operating unit 420 has an operating lever 421, and has a function of outputting an operation signal by carrying out the shift operations of forward movement/neutrality/reverse movement and throttle operation by the strokes thereof by a helmsman.

As shown in FIG. 23, the control unit 430 has the control unit 431 which can carry out PWM driving, a power circuit 432, and a voltage detecting circuit 433. The power circuit 432 is supplied with a DC voltage from the battery 500, and has a function of outputting the voltage to the control circuit 431. The voltage detecting circuit 433 has a function of detecting a power supply voltage applied to the power circuit 432 and inputting the voltage value to the control circuit 431.

An operating lever input signal (operation signal) from the operating unit 420 and a motor positional signal for detecting a motor position of a motor 422 of the driving unit 440 which will be described later are further input to the control circuit 431. On the other hand, as an output, a driving output voltage with respect to the driving unit 440 is output. This driving output voltage is determined as will be described later.

In the control circuit 431, an H-shaped bridge as shown in FIG. 24 is configured of transistors. Namely, a first upstream transistor QA and a first downstream transistor QB' which are connected in series, and a second upstream transistor QB and a second downstream transistor QA' which are connected in series are provided therein. The terminals of the motor 442 are connected between a series connecting point M of the first upstream transistor QA and the first downstream transistor QB' and a series connecting point N of the second upstream transistor QB and the second downstream transistor QA'. The first upstream transistor QA and the second upstream transistor QB are connected to the plus terminal of the battery 500, and the first downstream transistor QB' and the second downstream transistor QA' are connected to the minus terminal of the battery 500.

The driving unit 440 has a housing 441 attached to an outboard motor 510, a motor 442 arranged in the housing 441, an arm 443 whose basic end is attached to the rotation shaft of the motor 442, and a wire 444 attached to the point end of the arm 443. The wire 444 is attached to a shift arm 511 which will be described later and a throttle arm 512 which will be described later.

The shift arm 511 and the throttle arm 512 are provided at the outboard motor 510. The shift arm 511 has a function of determining forward movement/neutrality/reverse movement in accordance with the angular position thereof, and the throttle arm 512 has a function of determining a speed of the angular position thereof.

In the engine control apparatus 6 configured in this way, controlling of the outboard motor 510 is carried out as follows. Namely, first, initialization (ST10) is carried out at the same time of turning the power source on. Next, a normal/reverse rotation direction and a rotating quantity of the motor 442 are calculated on the basis of a voltage value of the battery 500, an operating lever position of the operating lever 421 operated by the helmsman, and a current motor value of the motor 442 of the driving unit 440.

The voltage applied from the battery 500 is detected at the voltage detecting circuit 443, is converted into a 1/19 of the voltage, and is read as a battery voltage value at the control circuit 431 (ST11).

Next, a position XL of the operating lever 421 is read (ST12). Moreover, the current value Xa of the motor 442 is read (ST13). Next, a difference between the position XL of the operating lever 421 and the current value Xa of the motor 442 is calculated (ST14). When the finite difference thereof is positive, because the current value of the motor 442 is insufficient, a driving voltage for normally rotating the motor 442 is calculated (ST20), and the motor 442 is made to normally rotate (ST21). The driving of the motor 442 will be described later.

On the other hand, when the finite difference thereof is negative, because the current value of the motor 442 is excessive, a driving voltage for rotating the motor 430 into reverse is calculated (ST30), and the motor 442 is made to rotate into reverse (ST31). Further, the routine returns to ST12, and the same operations are repeated.

Further, when the finite difference thereof is 0, because the quantity of movement of the output arm 456 is normal, the motor 430 is made to stop (ST40). Then, the routine returns to ST11, and the same operations are repeated.

Here, the voltage applied to the motor 442 is described. When a rating of the motor 442 is 12V and the battery 500 is 12V, the first upstream transistor QA and the second downstream transistor QA' are closed, and the second upstream transistor QB and the first downstream transistor QB' are opened. In accordance therewith, 12V electric power in the normal rotation direction is applied to the motor 442.

Note that, when the motor 442 is made to rotate into reverse, the first upstream transistor QA and the second downstream transistor QA' are opened, and the second upstream transistor QB and the first downstream transistor QB' are closed.

On the other hand, when the voltage from the battery 500 is higher than the rating of the motor 442, PWM control is carried out. For example, when the rating of the motor 442 is 12V and the battery 500 is 24V, the second upstream transistor QB and the first downstream transistor QB' are opened, and the first upstream transistor QA is closed, and an arbitrary rectangular wave is applied to the second downstream transistor QA', whereby the opening/closing thereof is carried out in a moment. Due to the time of applying the rectangular wave being made to be 50%, i.e., when the times of being ON and OFF are equal, a voltage of 12V which is half of the voltage of the battery 500 is applied to the motor 442. Note that a ratio of the time of applying the rectangular wave can be calculated by [rated voltage of the motor 442]/[applied voltage with respect to the control unit 430].

As described above, in accordance with the engine control apparatus 6 according to the present embodiment, when a voltage higher than the rating of the motor 442 is input to the control circuit 431, a voltage suitable for the rating of the motor 442 can be applied to the motor 442 by carrying out PWM control. Therefore, it is possible to prevent the high voltage from being directly applied to the motor 442 even when a high voltage is applied to the control circuit 431 due to the minus line of the power source lines being detached, or the like, and it is possible to prevent the motor 442, the shift arm 511 and the throttle arm 512 of the outboard motor 510 from being broken down.

Further, because it is preferable that the voltage of the battery 500 is higher than the rated voltage of the motor 442, choices of the motor 442 are made broader. Therefore, there is no need to prepare plural types of the motors 442 in accordance with a voltage of the battery 500, and it is possible to suppress a volume of the inventories to a minimum.

Figure 26:
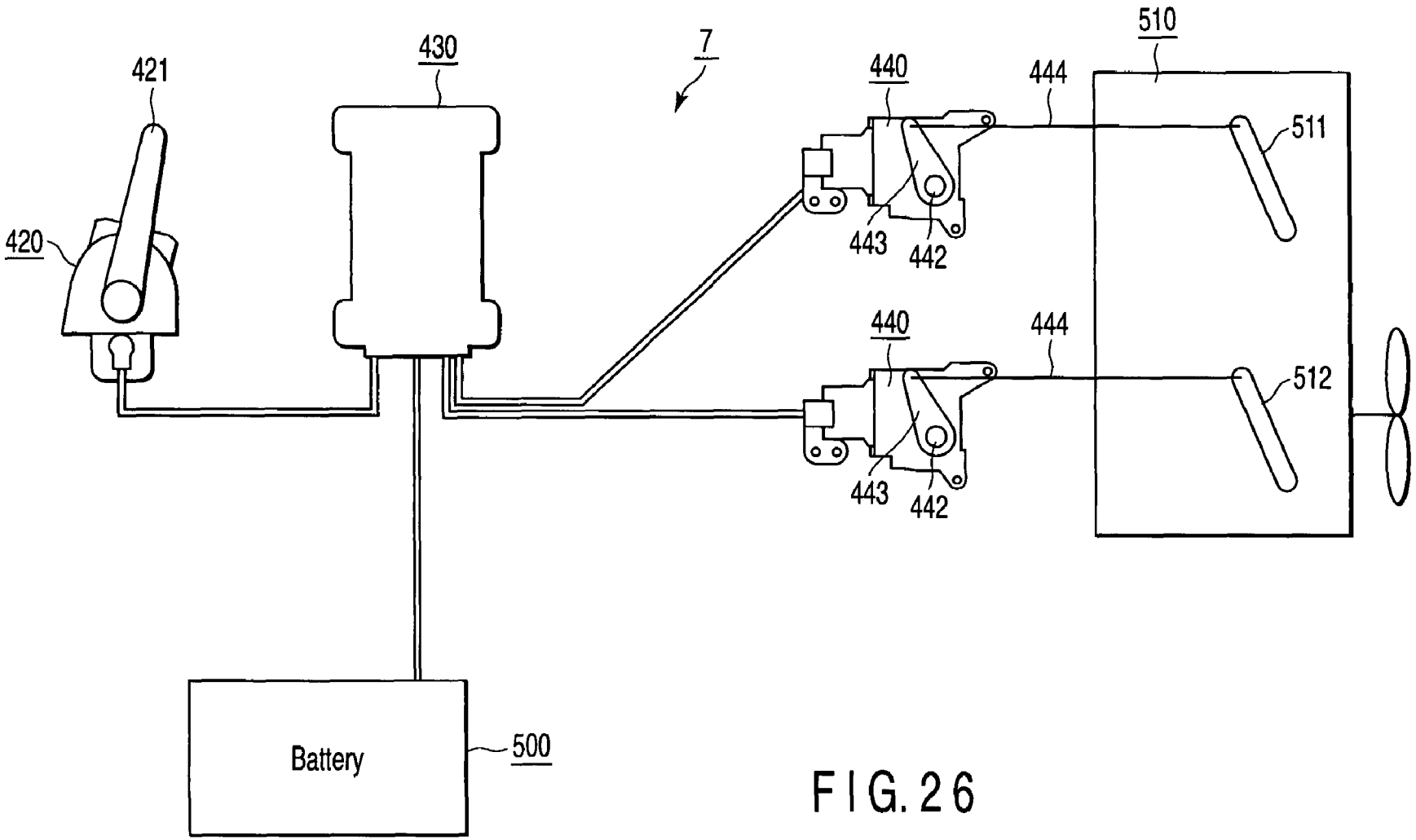
FIG. 26 is an explanatory diagram showing a configuration of an engine control apparatus according to a seventh embodiment of the present invention.

FIG. 26 is a schematic diagram showing a configuration of an engine control apparatus 7 for a medium-sized ship according to a seventh embodiment of the present invention. Note that portions in FIG. 26 which have the same functions as those of FIG. 22 are denoted by the same reference numerals, and detailed descriptions thereof will be omitted.

The driving unit 440 of the engine control apparatus 6 described above is attached so as to be integrated with the outboard motor 510. However, the driving unit 440 of the engine control apparatus 7 according to the present embodiment is configured to be a separated body from the outboard motor 510. In the engine control apparatus 7 according to the present embodiment as well, the same effect as the engine control apparatus 7 described above can be obtained.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An electronic remote control apparatus for a medium-sized ship, for remote-controlling an engine by a helmsman, comprising:

a control head which is arranged in a pilothouse, and which outputs an operation signal on the basis of an operating instruction to the engine input by the helmsman; and a control unit which is connected to or built into the control head, and which outputs a driving signal of the engine on the basis of the operation signal, wherein the control unit has a detecting unit which determines it is unusual when the operation signal is not normally received, and which outputs an alarm signal, and the control head has a display unit which specifies and displays an unusual portion on the basis of the alarm signal.

2. An electronic remote control apparatus for a medium-sized ship, according to claim 1, further comprising a sensor which senses an operating state of at least one of the control head, the control unit, and the engine, wherein the detecting unit determines an unusual portion on the basis of sensed information at the sensor, and outputs an alarm signal for specifying the unusual portion.

3. An electronic remote control apparatus for a medium-sized ship, according to claim 1, wherein the engine comprises:

at least one of a shift arm and a throttle arm;

a driving unit which operates the shift arm and the throttle arm by the driving signal; and a unit sensor which senses a driving state of the driving unit, and the detecting unit determines an unusual portion on the basis of sensed information sensed at the driving unit sensor, and outputs an alarm signal for specifying the unusual portion.

4. An electronic remote control apparatus for a medium-sized ship, according to claim 1, further comprising a sound warning unit which outputs a sound signal on the basis of the alarm signal.

5. An electronic remote control apparatus for a medium-sized ship, according to claim 1, wherein a plurality of the control heads are provided, and each control head adds an identification number which is specific to each control head to the operation signal and outputs it.

6. An electronic remote control apparatus for a medium-sized ship, according to claim 5, wherein the identification number is stored by a setting storage unit provided at the control head.

7. An electronic remote control apparatus for a medium-sized ship, according to claim 5, wherein the identification number is for determining an order of precedence of a corresponding operation signal.

8. An electronic remote control apparatus for a medium-sized ship according to claim 1, wherein the control unit has a setting information storage unit which stores a PUSH/PULL polarity and a stroke of a shift to the engine in the driving unit and a PUSH/PULL polarity and a stroke of a throttle.

9. An engine control apparatus comprising:

a control unit which outputs an operation signal corresponding to an operating instruction operated by a helmsman;

an actuator which actuates a shift mechanism and a throttle mechanism of an engine of an outboard motor by a driving force of an electric motor; and a control unit which supplies electric power from an power source to the electric motor on the basis of the operation signal from the control unit, wherein the control unit has a first upstream transistor and a first downstream transistor whose main current-carrying paths are connected in series, and a second upstream transistor and a second downstream transistor whose main current-carrying paths are connected in series, and the motor is connected between a series connecting point of the first upstream transistor and the first downstream transistor and a series connecting point of the second upstream transistor and the second downstream transistor, and a current path from one direction to another direction with respect to the motor is formed by turning the first upstream transistor and the second downstream transistor as a pair on, and a quantity of electric current made to flow in the current path is adjusted by PWM-driving the second downstream transistor, and on the other hand, a current path from one direction to another direction with respect to the motor is formed by turning the second upstream transistor and the first downstream transistor as a pair on, and a quantity of electric current made to flow in the current path is adjusted by PWM-driving the first downstream transistor.

* * * * *